US010905259B2

(12) United States Patent
Spain, Jr.

(10) Patent No.: US 10,905,259 B2
(45) Date of Patent: Feb. 2, 2021

(54) MULTIPLE CONFIGURATION MERCHANDISING SYSTEM

(71) Applicant: American Display & Fixture, LLC, Dalton, GA (US)

(72) Inventor: Walter Glenn Spain, Jr., Cleveland, TN (US)

(73) Assignee: American Display & Fixture, LLC, Dalton, GA (US)

( * ) Notice: Subject to any disclaimer, the term of this patent is extended or adjusted under 35 U.S.C. 154(b) by 0 days.

(21) Appl. No.: 16/551,117

(22) Filed: Aug. 26, 2019

(65) Prior Publication Data

US 2020/0069083 A1 Mar. 5, 2020

Related U.S. Application Data

(60) Provisional application No. 62/724,562, filed on Aug. 29, 2018.

(51) Int. Cl.

| | |
|---|---|
| ***A47F 5/08*** | (2006.01) |
| ***A47F 5/00*** | (2006.01) |
| ***A47F 5/10*** | (2006.01) |

(52) U.S. Cl.

CPC ..... *A47F 5/0823* (2013.01); *A47F 5/0018* (2013.01); *A47F 5/083* (2013.01); *A47F 5/0815* (2013.01); *A47F 5/0846* (2013.01); *A47F 5/101* (2013.01)

(58) Field of Classification Search

CPC ..... A47F 5/0823; A47F 5/0018; A47F 5/083; A47F 5/0846; A47F 5/101

See application file for complete search history.

(56) References Cited

U.S. PATENT DOCUMENTS

| | | | | | |
|---|---|---|---|---|---|
| 2,963,173 | A * | 12/1960 | Barnes | A47F 5/0815 | 211/189 |
| 2,991,889 | A * | 7/1961 | Levy | A47B 91/00 | 211/190 |
| 3,021,961 | A * | 2/1962 | Ruhnke | A47B 47/022 | 211/190 |
| 3,110,531 | A * | 11/1963 | Nowicki | E06B 3/4663 | 312/140.3 |
| 3,148,638 | A * | 9/1964 | Shelor | A47B 96/04 | 108/108 |
| 3,159,437 | A * | 12/1964 | Jentzen | A47B 96/04 | 312/108 |
| 3,200,961 | A * | 8/1965 | Kolster | A47F 5/101 | 211/186 |
| 3,221,894 | A | 12/1965 | Elgin, III | | |

(Continued)

FOREIGN PATENT DOCUMENTS

| | | | | |
|---|---|---|---|---|
| DE | 29616580 U1 * | 12/1996 | ..... | A47F 5/083 |
| EP | 2705778 | 3/2013 | | |
| WO | 2011050406 | 5/2011 | | |

OTHER PUBLICATIONS

Metro Commercial shelving and InterMetro Shelving, available at https://www.containerstore.com/pdf/assembly/metro_assembly.pdf.

*Primary Examiner* — Stanton L Krycinski
(74) *Attorney, Agent, or Firm* — Miller & Martin PLLC

(57) ABSTRACT

Embodiments of the presently disclosed subject matter are modular wall systems and kits The described modular wall systems and kits capable of multiple configurations and accommodating a variety of accessories depending on the needs of the user.

20 Claims, 21 Drawing Sheets

(56) References Cited

U.S. PATENT DOCUMENTS 3,297,374 A * 1/1967 Radek ..... A47F 5/103 312/108
3,305,286 A * 2/1967 Fenwick ..... A47F 5/103 312/263
3,329,282 A * 7/1967 Swan ..... A47F 5/14 211/190
3,492,772 A * 2/1970 Bergman ..... A47F 7/24 52/633
3,830,374 A * 8/1974 Kassimir ..... A47F 5/103 211/1
3,908,830 A * 9/1975 Skrzelowski ..... A47F 5/08 211/55
3,971,477 A * 7/1976 Bruderly ..... A47F 5/103 211/189
4,018,340 A * 4/1977 Gold ..... A47F 7/175 211/44
4,046,083 A * 9/1977 Murdoch ..... A47F 5/103 108/107
4,093,078 A * 6/1978 Radek ..... A47F 5/103 211/182
4,744,475 A * 5/1988 St. Pierre ..... A47F 5/103 211/134
4,805,783 A * 2/1989 Mayer ..... A47F 5/0846 211/189
4,919,282 A * 4/1990 Duff ..... A47B 57/26 211/134
4,981,226 A * 1/1991 Shallenberg ..... A47F 5/0018 108/180
D336,183 S * 6/1993 Klein, III ..... D34/23
5,255,803 A * 10/1993 Pavone ..... A47F 5/00 211/189
5,443,167 A * 8/1995 Menaged ..... A47F 5/0823 211/103
D363,841 S 11/1995 Nourse
5,477,971 A * 12/1995 Howard ..... A47F 5/101 108/108
5,529,192 A * 6/1996 Conen ..... A47B 96/028 211/187
5,566,844 A * 10/1996 Bernardin ..... A47F 5/0846 211/162
5,607,070 A * 3/1997 Hellyer ..... A47F 5/108 211/189
5,660,286 A * 8/1997 Shea ..... A47F 5/08 211/189
5,785,190 A * 7/1998 Otema ..... A47F 5/0823 211/103
5,803,273 A * 9/1998 Menaged ..... A47F 5/0807 211/105.1
5,918,750 A * 7/1999 Jackson ..... A47F 5/137 108/108
5,921,190 A * 7/1999 Wood ..... A47F 5/103 108/106
6,116,326 A * 9/2000 Domina ..... E04B 2/7422 160/351
6,164,467 A 12/2000 DePottey et al.
6,193,083 B1 * 2/2001 Wood ..... A47B 57/425 211/103
6,394,267 B1 * 5/2002 Craig ..... B65D 88/528 206/321
6,427,855 B2 * 8/2002 LaBruna, Jr. ..... A47F 5/103 211/187
6,427,857 B1 * 8/2002 Adams ..... A47F 5/10 211/162
6,520,355 B1 2/2003 Pritchard et al.
6,564,952 B1 * 5/2003 Suttles ..... A47B 55/02 211/187
6,601,349 B1 * 8/2003 Corden ..... E04B 2/7453 52/126.4
6,659,295 B1 * 12/2003 De Land ..... A47B 96/04 211/184
6,739,463 B2 * 5/2004 Wishart ..... A47B 47/027 211/175
6,951,085 B2 * 10/2005 Hodges ..... E04B 2/7425 52/220.7
7,185,460 B2 * 3/2007 Corden ..... E04B 2/7453 52/220.7
7,261,214 B2 * 8/2007 Wagner ..... A47F 5/0823 108/147.11
7,270,242 B2 * 9/2007 Liu ..... A47B 47/024 211/189
7,296,697 B2 11/2007 Costa et al.
7,334,692 B2 2/2008 Black
7,494,019 B2 2/2009 Kessell et al.
7,810,658 B2 * 10/2010 Clark ..... A47F 5/137 211/189
7,886,919 B2 * 2/2011 Battaglia, Jr. ..... A47B 47/03 211/187
8,028,846 B2 * 10/2011 Peota ..... A47B 91/00 108/108
8,360,254 B2 * 1/2013 Topping ..... A47F 5/0815 211/87.01
D683,983 S 6/2013 Troyner et al.
D701,405 S 3/2014 Pace et al.
8,807,356 B2 * 8/2014 Weigand ..... A47F 5/10 211/183
8,919,579 B2 * 12/2014 Weigand ..... A47F 7/144 211/186
8,959,813 B2 * 2/2015 Denby ..... A47F 5/10 211/175
9,119,487 B2 * 9/2015 Angvall ..... A47F 5/0081
9,131,788 B2 * 9/2015 Lindblom ..... A47F 5/103
9,192,251 B1 * 11/2015 Theisen ..... A47F 5/0018
9,232,865 B2 * 1/2016 Trinh ..... A47F 5/10
9,282,816 B2 3/2016 Ahart
9,357,858 B2 * 6/2016 Sun ..... A47F 5/0018
D777,480 S 1/2017 Anderson
9,609,961 B2 * 4/2017 Lindblom ..... A47F 5/101
9,642,456 B2 5/2017 Cooper
9,774,134 B2 * 9/2017 Bonner ..... A47F 5/0815
D799,870 S 10/2017 Liss
9,936,825 B1 * 4/2018 Lindblom ..... A47F 5/0087
10,021,996 B2 * 7/2018 Cantwell ..... A47F 7/163
10,037,659 B2 * 7/2018 Wise ..... A47F 5/103
10,384,702 B2 * 8/2019 Murray ..... A47F 5/103
2004/0011755 A1 * 1/2004 Wood ..... F16B 12/02 211/189
2005/0167383 A1 8/2005 Taccolini et al.
2006/0016774 A1 * 1/2006 Bustos ..... A47B 57/04 211/186
2009/0050589 A1 2/2009 Huang et al.
2010/0155347 A1 6/2010 McConnell et al.
2011/0233164 A1 9/2011 Chang
2012/0193311 A1 * 8/2012 Benasillo ..... G09F 7/18 211/59.2
2013/0093298 A1 4/2013 Ehmke et al.
2014/0116973 A1 5/2014 Buckley et al.
2014/0149242 A1 * 5/2014 Turner, Jr. ..... A47B 55/02 705/26.1
2018/0103781 A1 4/2018 Taylor et al.

* cited by examiner

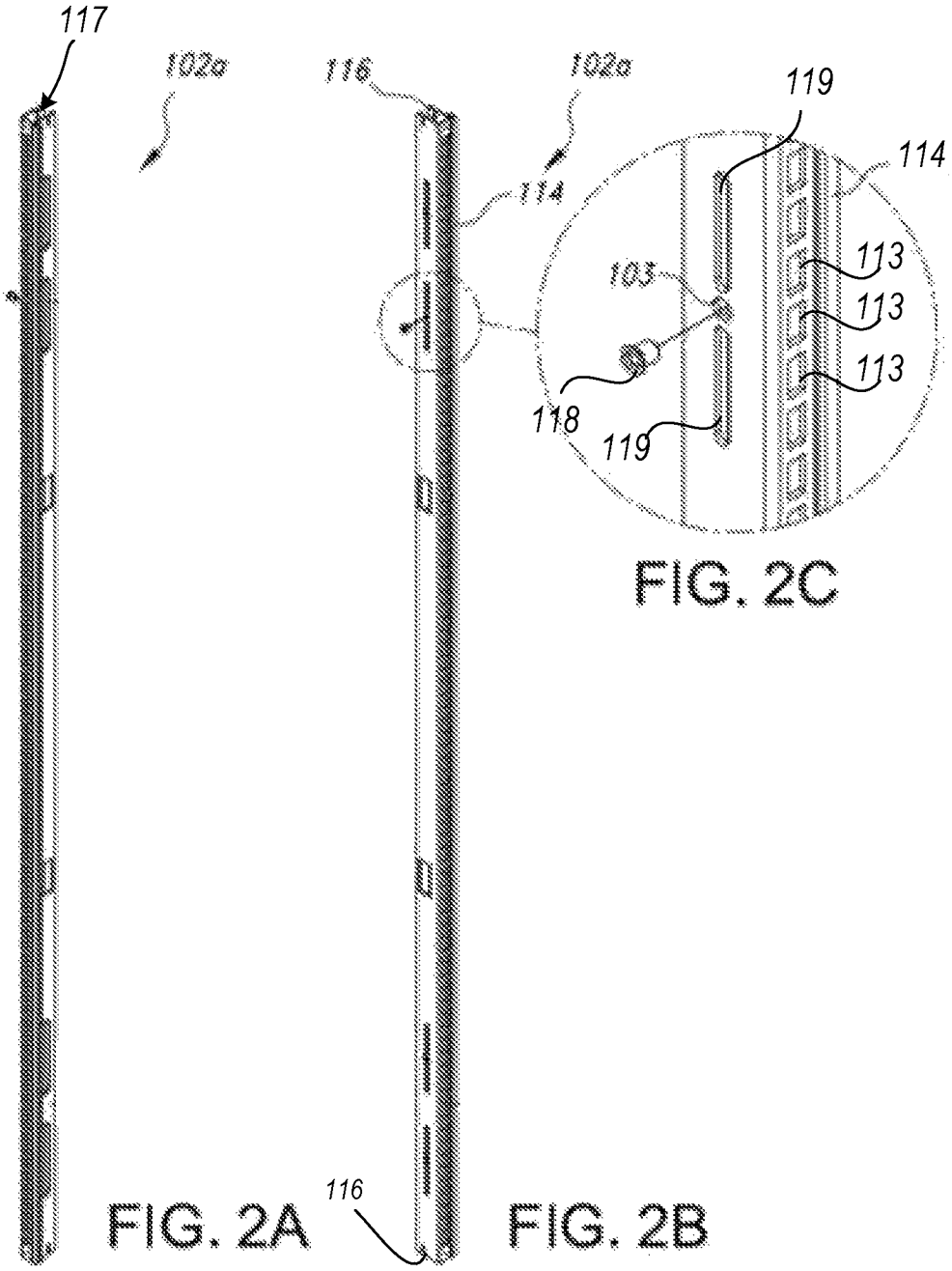
FIG. 2A
FIG. 2B
FIG. 2C
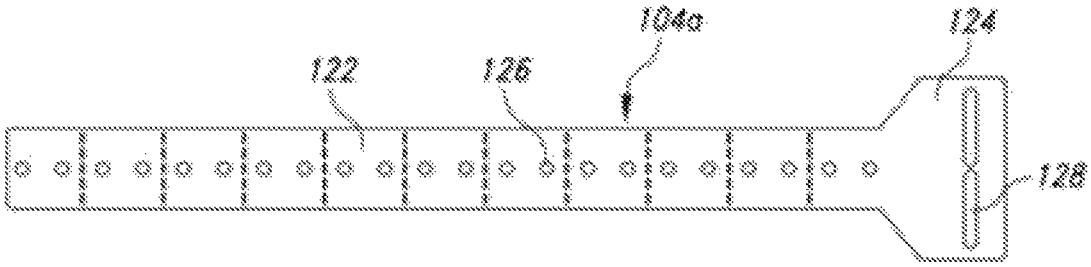
FIG. 3

MULTIPLE CONFIGURATION MERCHANDISING SYSTEM

CROSS-REFERENCE TO RELATED APPLICATIONS

This application titled "Multiple Configuration Merchandising System" is a non-provisional application claiming the benefit to Provisional Application No. 62/724,562 filed Aug. 29, 2018 and titled "Multiple Configuration Merchandising System," which is hereby incorporated by reference in its entirety as if set forth below.

TECHNICAL FIELD

Embodiments of the presently disclosed invention relate to modular wall systems and kits and in exemplary embodiments, modular wall systems and kits capable of multiple configurations and useful in a merchandising system.

BACKGROUND

Retailers are often faced with the challenge of displaying products and information to consumers in an attractive yet efficient way. However, for retailers with a wide variety of products of different sizes, shapes, and complexities, it is often difficult to find a display means that will accommodate a variety of products and/or fit with existing shelving in stores. This problem requires retailers to seek out custom shelving or fixtures to meet their various needs, which can be costly and inefficient. Conventionally, retailers have also used wood pegboard or gondola shelving that can receive some types of accessories. Pegboard and gondola shelving is cumbersome to ship and not adaptable to a variety of retailer needs. Additionally, pegboard, particularly wood pegboard, wears quickly overtime. Therefore, there is a need for a flexible and cost-effective display rack system capable of meeting the needs of retailers for custom displays and fixtures. The various embodiments described in the present disclosure are directed to these and other considerations.

SUMMARY

The modular wall systems and kits of the present disclosure solve pervasive issues with assembly, manageability, flexibility, and cost seen with conventional display schemes. In the instance of retailers, conventional display schemes require purchasing several different customized display or shelving systems depending on the display needs at the time. This can result in considerable expense and waste to retailers over time. The modular wall systems and kits of the present disclosure offer a display method that is capable of accommodating a variety of retailer or user needs, such as hanging a variety of items of different sizes with limited wear over time, accommodating product shelving of various sizes and shapes, accommodating product advertising displays, and integrating with existing shelving that a retailer may have. Additionally, the modularity of the wall systems and kits improves both shipping efficiency and costs, not realized by existing display systems, such as pegboard or gondola shelving, which are regularly very cumbersome and costly to ship. Due to the modular nature of the presently disclosed systems and kits, the modular wall systems are capable of disassembly into various discrete and compact parts that facilitate more efficient moving, shipping, and rearranging over time.

Embodiments of the present disclosure include modular wall systems or kits capable of multiple configurations. In some embodiments, the modular wall systems are one-size-fits-all to provide retailers with a flexible and affordable solution to meet their needs for custom displays and fixtures. In some embodiments, the modular wall systems may be integrated with existing store racking or shelving units. Embodiments of the presently disclosed modular wall systems may be advantageous because they can be adjustable in height and depth of racking, are portable, and are easy to assemble. In some embodiments, the disclosed modular wall systems may accommodate a variety of accessories including, but not limited to, pegboards, peg hooks, graphics, displays, adjustable shelving, and base shelving. The modular wall systems are easy to assemble in that the display rack systems do not require specialized tools or skill sets besides general mechanical aptitude. The display rack systems are portable and/or collapsible in that the entire unit can be broken down and packed flat to ship out via traditional package shipping companies, such as FedEx or UPS, thus eliminating the need for dedicated trucks or the utilization of more expensive traditional trucking companies.

Embodiments of the presently disclosed invention include a modular wall system for use in accordance with a shelving unit. In some embodiments, the modular wall system can comprise a frame composed of a plurality of vertical uprights, a top cap, and a bottom cap, a plurality of vertical support members removably coupled to the frame, a plurality of pegboard sections removably disposed within the frame, the plurality of pegboard sections interconnected via at least one seam member, and a plurality of brackets removably coupled to the frame, the plurality of brackets comprising a brace member comprising a plurality of holes disposed lengthwise across the brace member and configured to removably couple with frame and a flange comprising one or more slots configured to removably couple with the shelving unit.

In some embodiments, the modular wall system may further comprise a plurality of horizontal support members coupled to the frame.

In some embodiments, the plurality of vertical uprights of the modular wall system may comprise a first outer vertical upright, a central vertical upright, and a second outer vertical upright.

In some embodiments, the first and second outer vertical uprights of the modular wall system may each comprise a channel configured to couple to at least one of the plurality of pegboard sections.

In some embodiments, the central vertical upright of the modular wall system may comprise two channels, each channel disposed on a corresponding vertical edge of the central vertical upright and configured to couple to at least one of the plurality of pegboard sections.

In some embodiments, each of the plurality of vertical uprights of the modular wall system may comprise a top connector configured to removably couple to the top cap and a bottom connector configured to removably couple to the bottom cap.

In some embodiments, the modular wall system may further comprise a plurality of accessories including one or more of a shelf, a graphic display board, a hang bar, a base, and a pod unit.

In some embodiments, the plurality of pegboard sections of the modular wall system may be composed of a metal.

In some embodiments, the at least one seam of the modular wall system may comprise a top channel for receiving a bottom edge of a first pegboard section and a bottom channel for receiving a top edge of a second pegboard section.

Embodiments of the presently disclosed invention may further include a kit comprising components for constructing a modular wall system. In some embodiments, the components of the kit can include: a plurality of vertical uprights having a pre-determined length; a top cap; a bottom cap; a plurality of vertical support members; a plurality of pegboard sections chosen from the group consisting of metal pegboard and wood pegboard; a plurality of seam members; and a plurality of brackets. In some embodiments, the kit components can be contained in two separate packages.

In some embodiments, the components of the kit may further comprise a plurality of fasteners chosen from the group consisting of split end lock washers, threaded rack anchors, Philips head screws, half hex rivet nuts, and sems screws.

In some embodiments, the components of the kit may further comprise three vertical uprights, two vertical support members, eight pegboard sections, four brackets, and six seams.

In some embodiments, the components of the kit may further comprise a plurality of horizontal support members.

In some embodiments, the components of the kit may comprise four horizontal support members.

In some embodiments, the kit may further comprise a plurality of accessories including one or more of a shelf, a graphic display board, a hang bar, a base, and a pod unit.

BRIEF DESCRIPTION OF THE DRAWINGS

FIGS. 2A and 2B are right and left perspective views illustrating vertical uprights, according to an example embodiment of the presently disclosed invention.

FIG. 2C illustrates an example fastening mechanism for connecting a bracket to a vertical upright, according to an example embodiment of the presently disclosed invention.

FIG. 3 illustrates a bracket for connecting the modular wall system to existing shelving, according to an example embodiment of the presently disclosed invention.

DETAILED DESCRIPTION

Figure 1A:
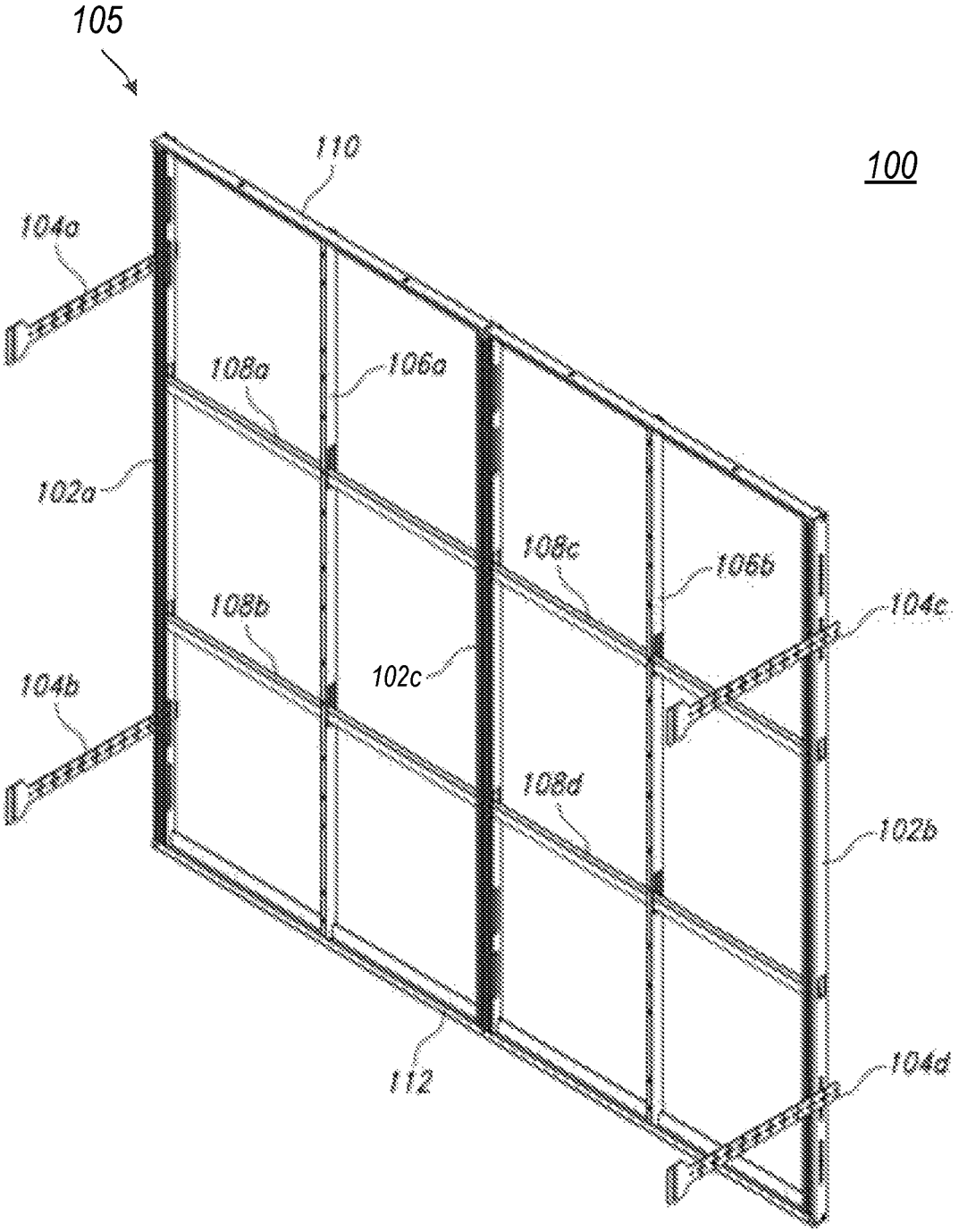
FIG. 1A illustrates an assembled modular wall system with pegboard sections removed, according to an example embodiment of the presently disclosed invention.
Figure 1B:
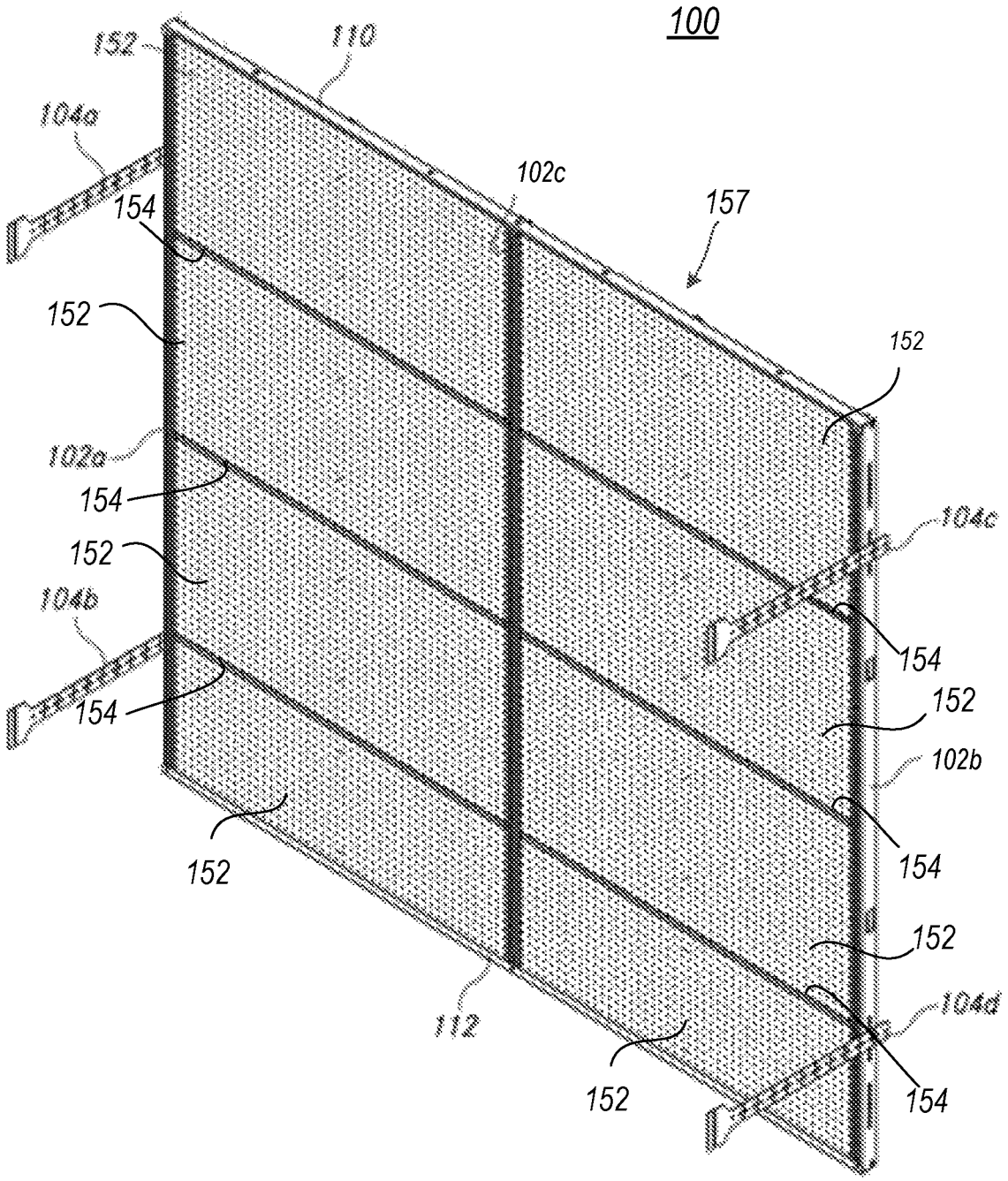
FIG. 1B illustrates an assembled modular wall system with pegboard sections inserted, according to an example embodiment of the presently disclosed invention.

Turning to the Figures which show an example modular wall system and various system components, FIG. 1A-1D show various views of a modular wall system 100. FIG. 1A illustrates an assembled framework 105 of a modular wall system 100 with pegboard sections (not shown) removed, according to an example embodiment of the presently disclosed invention. The modular wall system 100 may comprise a plurality of vertical uprights 102*a*, 102*b*, 102*c*, a plurality of brackets 104*a*, 104*b*, 104*c*, 104*d*, a plurality of vertical support members 106*a*, 106*b*, a plurality of horizontal support members 108*a*, 108*b*, 108*c*, 108*d*, a top cap 110, and a bottom cap 112. When the pegboard sections 152 are inserted within the assembled framework 105, as illustrated in FIG. 1B, the modular wall system 100 can further comprise a plurality of seams 154, which can interconnect the pegboard sections 152 to form a pegwall 157 comprising a plurality of adjacent pegboard section 152.

As shown in FIGS. 1A and 1B, the modular wall system 100 may comprise a plurality of vertical uprights 102*a*, 102*b*, 102*c*. In some embodiments, the modular wall system 100 may comprise a first outer vertical upright 102*a*, a second outer vertical upright 102*b*, and optionally a central vertical upright 102*c*. The first outer vertical upright 102*a* may define a first outer edge of the modular wall system 100 and the second vertical upright 102*b* may define a second outer edge of the modular wall system 100. The central vertical upright 102*c* can be located proximate a central portion of the modular wall system 100, as illustrated in FIGS. 1A and 1B, to add additional structural support in the event the modular wall system 100 includes additional peg sections. When assembled, as illustrated in FIGS. 1A and 1B, the first and second outer vertical uprights 102*a*, 102*b*, couple to the top cap 110 and the bottom cap 112 to form a frame of the modular wall system 100 and provide both structural support and integrity to the modular wall system 100. The central vertical upright 102*c* may similarly couple to the top cap 110 and bottom cap 112 to add additional structural support, depending on the size of the vertical wall or the number of pegboard sections.

FIGS. 2A-2C illustrate an example structure of the vertical uprights 102*a*, 102*b*. In some embodiments, the vertical uprights 102*a*, 102*b*, 102*c* may comprise substantially flat side and front surfaces. The substantially flat side surfaces can comprise a plurality of upright holes 103 configured to connect or couple with various system components, including brackets 104*a*, 104*b*, 104*c*, 104*d*, or various accessories such as single-hook shelf 173 shown in FIG. 21 or double-hook hang bars (174 shown in FIG. 20) or shelves 170, 171, 172 (shown in FIGS. 11A-11C).

Returning to FIG. 2 in some embodiments, the substantially flat front surface can be perforated with a plurality of apertures 113 spanning nearly the entire height of the vertical upright 102*a*, 102*b*, 102*c* and disposed equidistant along a longitudinal axis of the vertical upright 102*a*, 102*b*, 102*c*. In some embodiments as shown in FIG. 2C, the substantially flat front surface of the vertical uprights 102*a*, 102*b* may also comprise one or more members 114 for receiving corresponding attachment.

Figure 18:
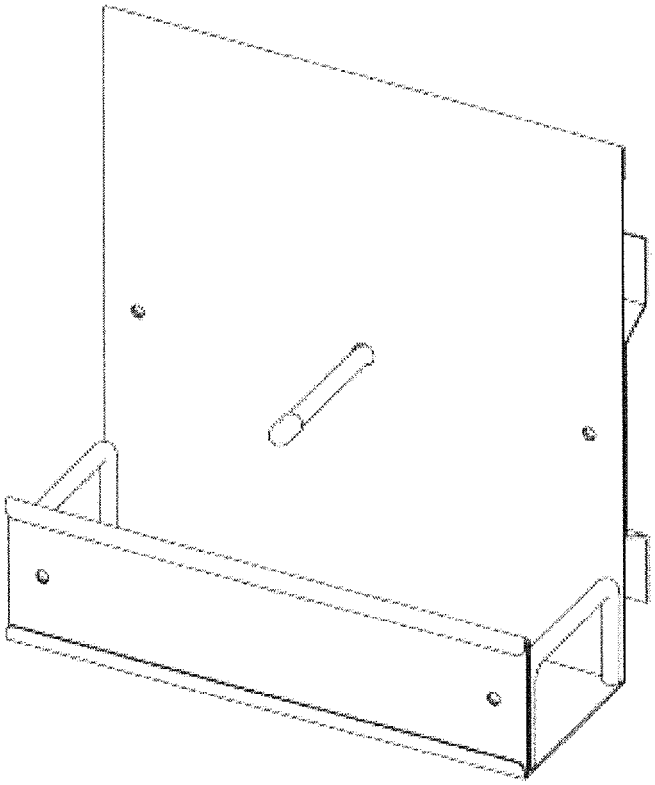
FIG. 18 illustrates a pod unit, according to an example embodiment of the presently disclosed invention.

The vertical uprights 102*a*, 102*b*, 102*c* may further comprise an upright connector 116 disposed proximate either of both ends of the vertical uprights 102*a*, 102*b*, 102*c* for connecting to the bottom cap 112 and the top cap 110 as shown in FIG. 18. In some embodiments, the vertical uprights 102*a*, 102*b*, 102*c* may be substantially hollow and thus comprise an internal channel spanning 117 nearly the entire height of the vertical upright 102*a*, 102*b*, 102*c*.

Figure 4:
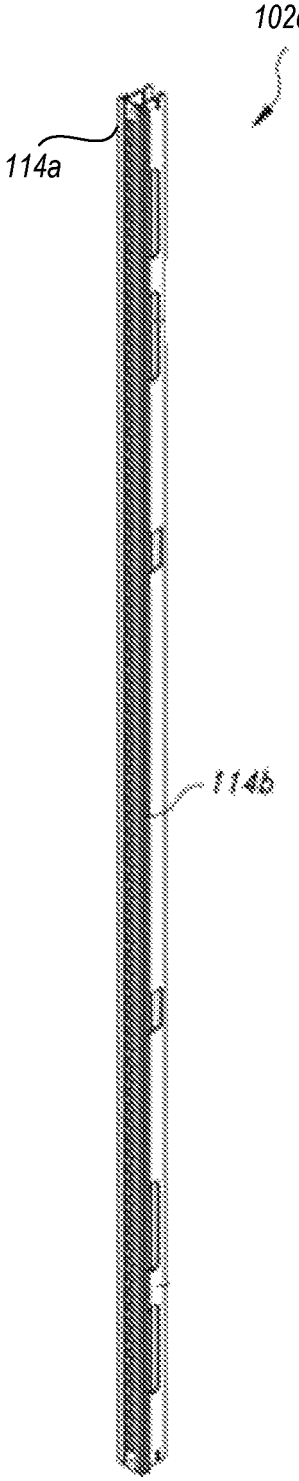
FIG. 4 illustrates a central vertical upright, according to an example embodiment of the presently disclosed invention.

As shown in FIG. 2C, in some embodiments, the front surface of the vertical uprights 102*a*, 102*b*, 102*c* may comprise at least one channel member 114 spanning nearly the entire height of the vertical upright 102*a*, 102*b*, 102*c* for receiving and releasably engaging a horizontal-facing edge of a plurality of pegboard sections 152. The channel member 114 may be substantially U-shaped and flexible such that a pegboard section can be snapped or slid down into the cannel member 114. In an example embodiment, the outside vertical uprights 102*a*, 102*b* may comprise one channel member 114 spanning an internal, vertical edge of the vertical uprights 102*a*, 102*b*, as illustrated in FIGS. 2A-2C, and the central vertical upright 102*c* may comprise channel members 114*a*, 114*b* spanning both vertical edges of the central vertical upright 102*c*, as illustrated in FIG. 4. As shown in FIG. 1B, in a typically-sized system, from one to four pegboard sections 152 may be stacked between vertical uprights 102*a* and 102*b*, and another set of up to four pegboard sections 152; may be stacked between vertical uprights 102*b* and 102*c*. Two or more modular wall systems 100 may be assembled one on top of another to accommodate a user's desire for a higher display. Of course, modular wall systems 100 may be fashioned to any desired dimensions, but the preferable size has been found to be a size best suited to be packaged to achieve, cost-effective shipping.

Figure 1C:
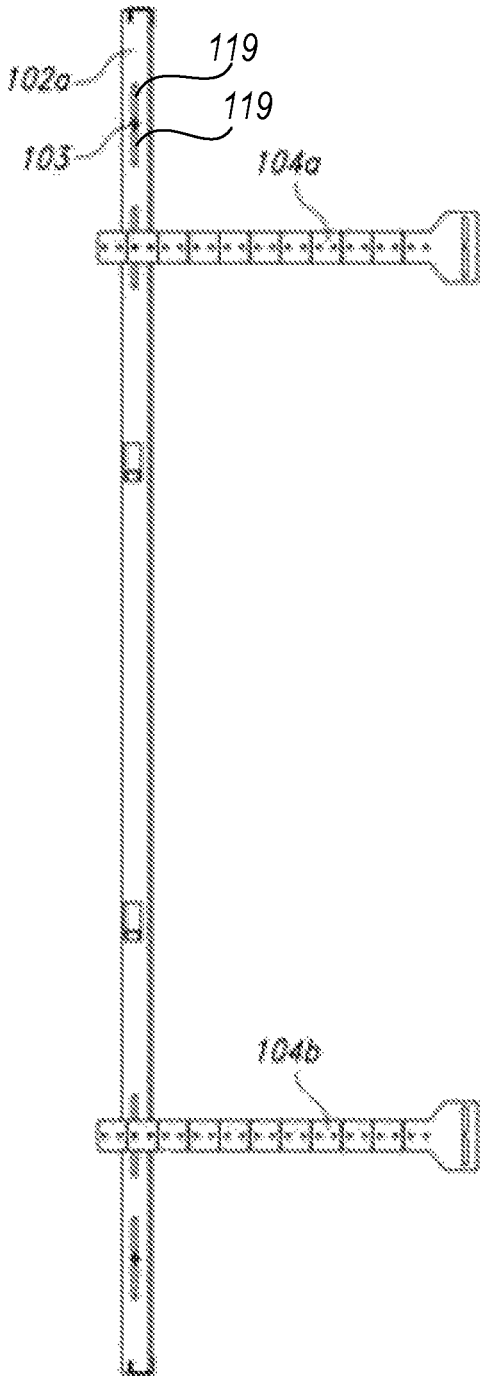
FIGS. 1C and 1D are side views illustrating an assembled modular wall system, according to an example embodiment of the presently disclosed invention.
Figure 1D:
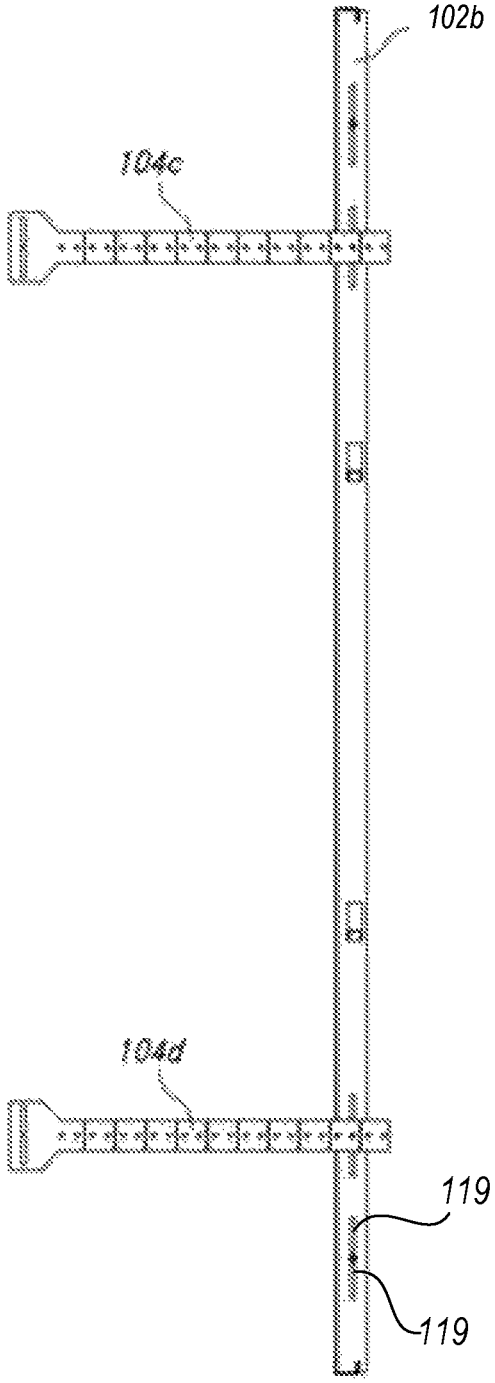

In some embodiments, the modular wall system 100 may optionally comprise a plurality of brackets 104*a*, 104*b*, 104*c*, 104*d* (shown in FIG. 3) for connecting the modular wall system 100 to existing shelving unit or other structure as shown in FIGS. 1C and 1D. The plurality of brackets 104*a*, 104*b*, 104*c*, 104*d* can be coupled to the first and second outer vertical uprights 102*a*, 102*b*, as illustrated in FIGS. 1A-1D. An exemplary coupling means is illustrated in FIG. 2C, namely using a fastener 118 to connect the plurality of brackets 104*a*, 104*b*, 104*c*, 104*d* to an upright hole 103.

FIGS. 1C and 1D show side views of the modular wall system 100, according to an example embodiment of the presently disclosed invention. As illustrated in FIGS. 1C and 1D, the brackets 104*a*, 104*b*, 104*c*, 104*d* may couple to the outer vertical uprights 102*a*, 102*b* via a plurality of upright holes 103 in the outer vertical uprights 102*a*, 102*b*. In some embodiments, the upright holes 103 may further comprise one or more upright slots 119 that allow the position of the brackets 104*a*, 104*b*, 104*c*, 104*d* to be adjusted in a vertical direction depending on the desired height and positioning of the brackets 104*a*, 104*b*, 104*c*, 104*d* with respect to an existing shelving unit or other structure.

As illustrated in FIG. 3, the plurality of brackets 104*a*, 104*b*, 104*c*, 104*d* can comprise a flange 124 and a brace 122. The brace 122 may comprise a plurality of brace holes 126 disposed lengthwise across the brace 122. The plurality of brace holes 126 can be configured to couple with the first and second outer vertical uprights 102*a*, 102*b* at various depths via the plurality of upright holes 103. Preferably the plurality of brace holes 126 are disposed at regular lengthwise intervals to aid the user in configuring the system 100. The flange 124 may comprise at least one flange slot 128 for connecting to existing shelving, as illustrated for instance in FIG. 9. In some embodiments, as illustrated in FIG. 3, the flange 124 may comprise two flange slots 128 for adjustably connecting to existing shelving.

As shown in FIG. 1A, the modular wall system 100 may comprise a plurality of horizontal support members 108*a*, 108*b*, 108*c*, 108*d*. The horizontal support members 108*a*, 108*b*, 108*c*, 108*d* can extend between the vertical uprights 102*a*, 102*b*, 102*c* and thereby provide additional support to the modular wall system 100. The horizontal support members 108*a*, 108*b*, 108*c*, 108*d* can connect to the vertical uprights 102*a*, 102*b*, 102*c* via a plurality of horizontal support interfaces for connecting to the horizontal support members 108*a*, 108*b*, 108*c*, 108*d*. The horizontal support members 108*a*, 108*b*, 108*c*, 108*d* may comprise a plurality of horizontal support member connectors disposed proximate each end of the horizontal support members 108*a*, 108*b*, 108*c*, 108*d* for coupling to the horizontal support interfaces of the vertical uprights 102*a*, 102*b*, 102*c*.

As shown in FIG. 1A, the modular wall system 100 may comprise a plurality of vertical support members 106*a*, 106*b*. The vertical support members 106*a*, 106*b* may extend from the top cap 110 to the bottom cap 112 of the modular wall system 100. The top cap 110 and the bottom cap 112 may comprise a plurality of vertical support interfaces for connecting to the vertical support members 106*a*, 106*b*. The vertical support members 106*a*, 106*b* may comprise a connector disposed proximate each end of the vertical support member 106*a*, 106*b* for coupling to the vertical support interfaces of the top cap 110 and the bottom cap 112. The vertical support members 106*a*, 106*b* may further comprise a plurality of channels, through which one or more of the horizontal support members 108*a*, 108*b*, 108*c*, 108*d* may extend through to connect between a first vertical upright 102*a* or 102*b* to a second vertical upright 102*b* or 102*c*.

Figure 6:
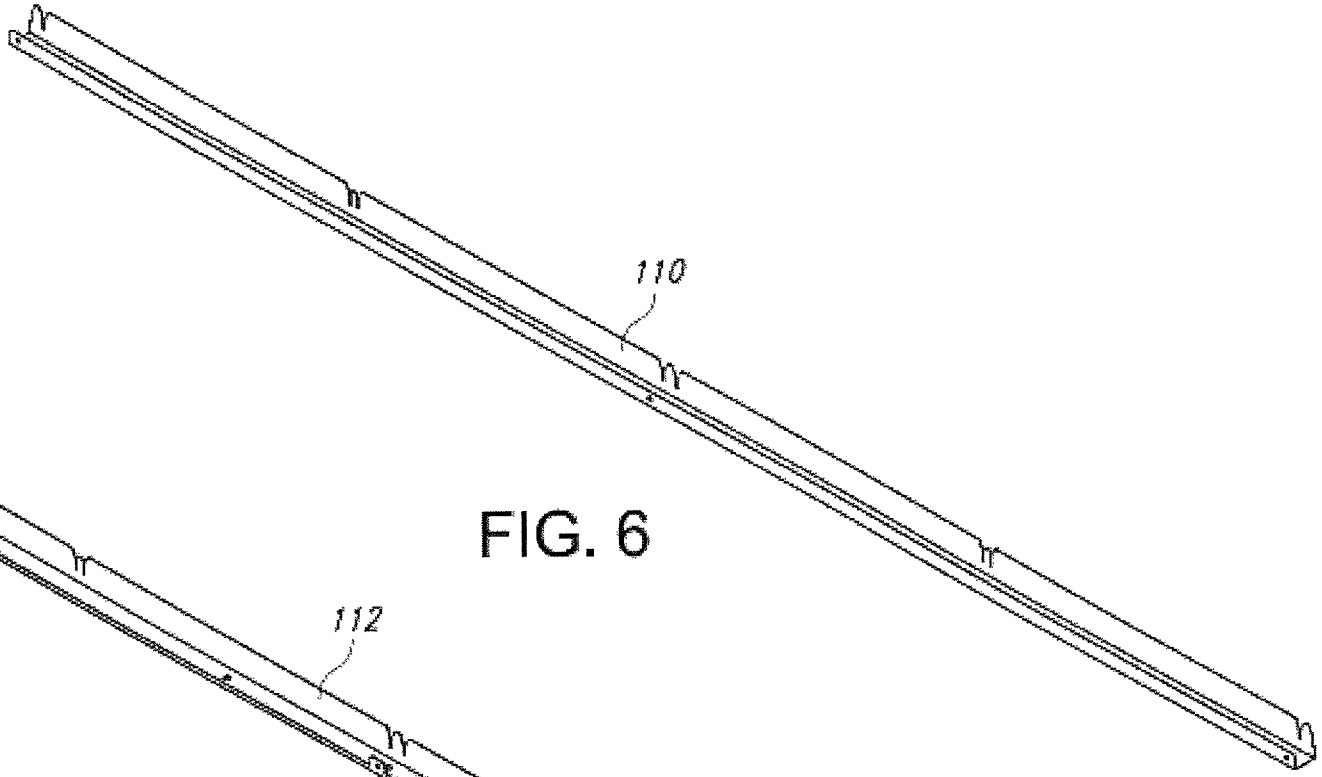
FIG. 6 illustrates a bottom cap for a modular wall system, according to an example embodiment of the presently disclosed invention.

As shown in FIG. 1A, the modular wall system 100 may comprise a bottom cap 112 defining a lower edge of the modular wall system. FIG. 6 shows an exemplary bottom cap 112, according to an example embodiment of the disclosed technology. The bottom cap 112 may comprise a plurality of vertical support interfaces for connecting to the vertical support members 106*a*, 106*b* and a plurality of vertical upright interfaces for connecting to the vertical uprights 102*a*, 102*b*, 102*c*. In some embodiments, the vertical support interfaces and the vertical upright interfaces may be sized and shaped to receive a correspondingly sized and shaped connector of the vertical support members 106*a*, 106*b* and the vertical uprights 102*a*, 102*b*, 102*c*.

Figure 7:
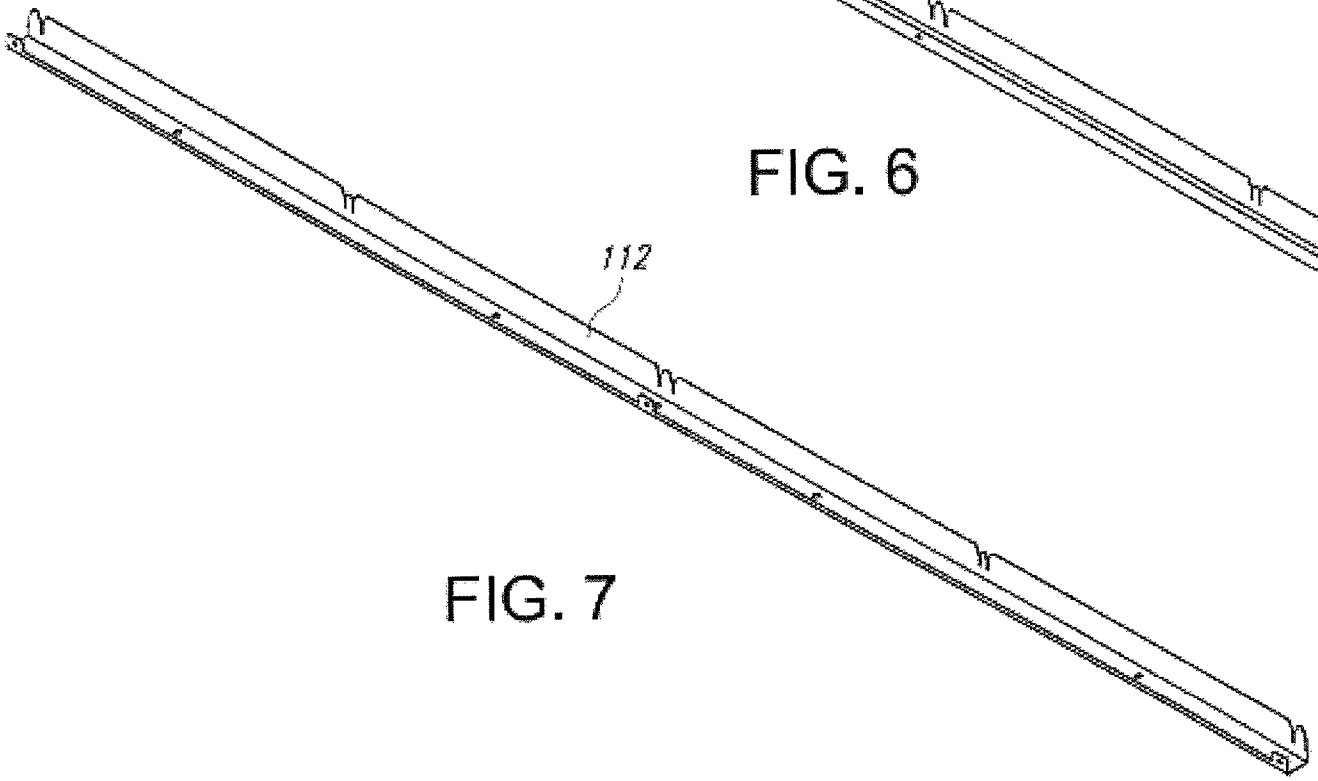
FIG. 7 illustrates a top cap for a modular wall system, according to an example embodiment of the presently disclosed invention.

As shown in FIG. 1, the modular wall system 100 may comprise a top cap 110 defining an upper edge of the modular wall system. FIG. 7 shows an exemplary top cap 110, according to an example embodiment of the disclosed technology. The top cap 110 can comprise a plurality of vertical support interfaces for connecting to the vertical support members 106*a*, 106*b* and a plurality of vertical upright interfaces for connecting to the vertical uprights 102*a*, 102*b*, 102*c*. In some embodiments, the vertical support interfaces and the vertical upright interfaces may be sized and shaped to receive a correspondingly sized and shaped connector of the vertical support members 106*a*, 106*b* and the vertical uprights 102*a*, 102*b*, 102*c*. In some embodiments, the top cap 110 may comprise a plurality of top cap holes 128 for receiving various accessories coupled to the top cap, such as display boards.

FIG. 1B illustrates a modular wall system 100 with pegboard sections 152 inserted. The modular wall system 100 may comprise a plurality of pegboard sections 152 connected together via seam members 154 (see FIG. 8). Returning to FIG. 1B, the plurality of pegboard sections 152 can then be connected to the vertical uprights 102*a*, 102*b*, 102*c* via the vertical channels 114. The number of pegboard sections can be increased or decreased as desired to fit design concerns. Similarly, the size of the pegboard sections 152 can be increased or decreased as desired to fit design concerns. Additionally, as illustrated in FIGS. 1A and 1B, the pegboard sections can be different sizes and shapes, typically rectangle or square.

Figure 5:
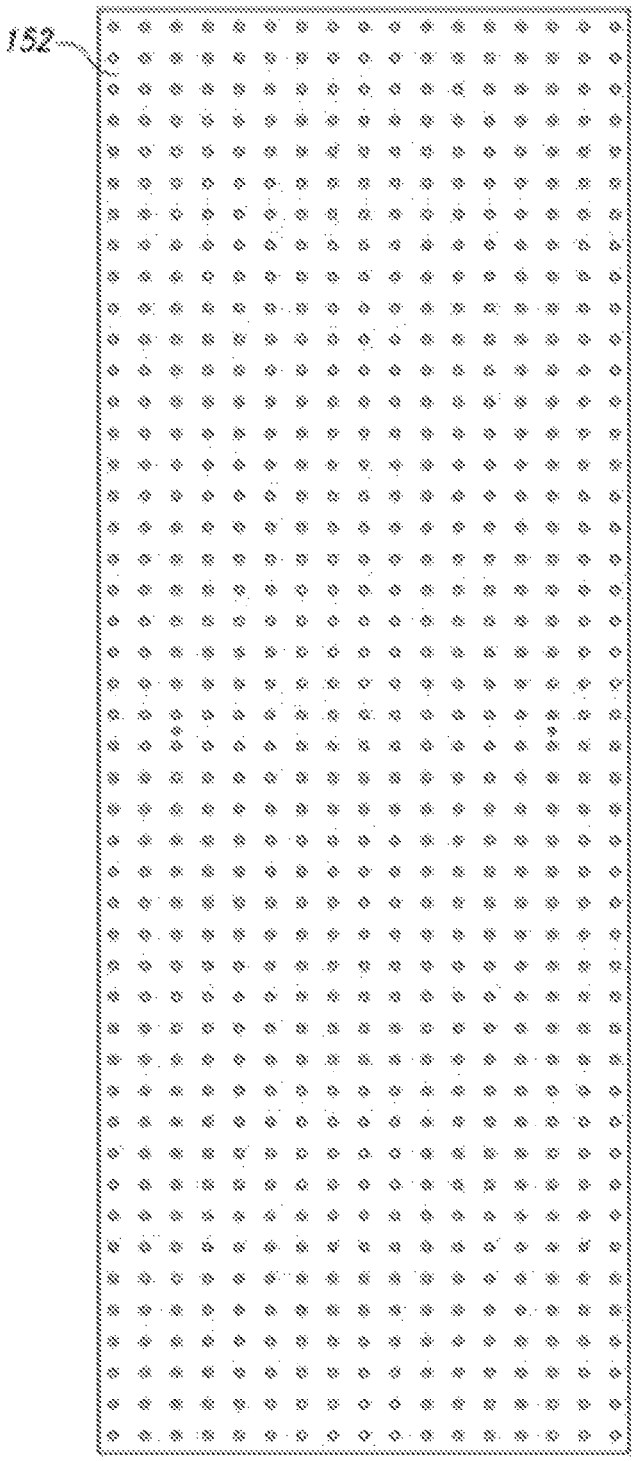
FIG. 5 illustrates a pegboard section for a modular wall system, according to an example embodiment of the presently disclosed invention.

FIG. 5 illustrates a pegboard section 152 that can be incorporated into the modular wall system 100. The pegboard sections 152 may comprise a plurality of peg holes for receiving a plurality of accessories, such as shelving, racks, peg hooks, and displays. The pegboard sections 152 can be metal pegboard or wood pegboard. In some embodiments, the peg holes can be about 1 inch apart, but the peg spacing can be adjusted as necessary to fit design concerns. The pegboard sections 152 can be various sizes as necessary to fit design concerns.

Figure 8:
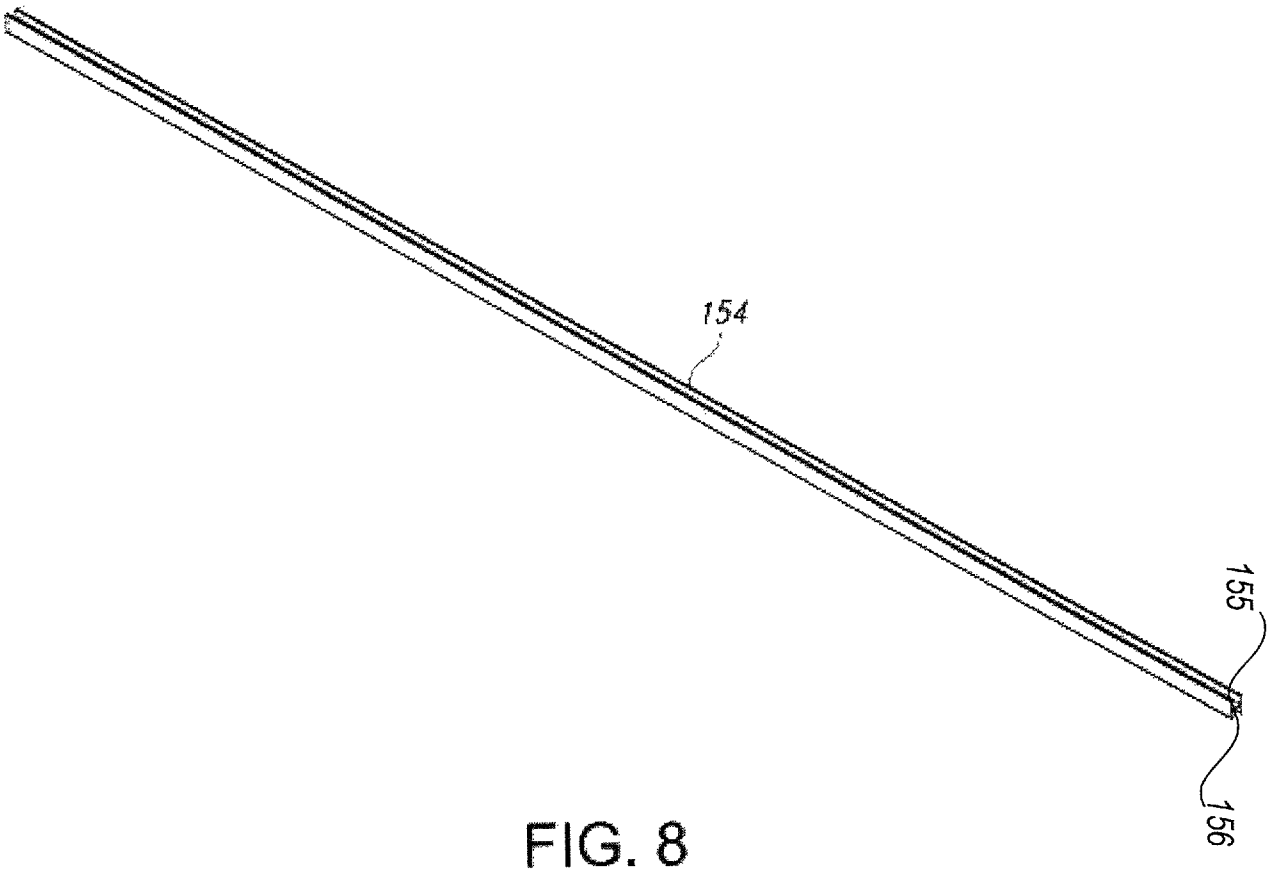
FIG. 8 illustrates a seam for connecting two pegboard sections together, according to an example embodiment of the presently disclosed invention.

FIG. 8 illustrates a seam member or seam 154 for interconnecting pegboard sections (not shown), according to embodiments of the presently disclosed invention. The seam 154 may comprise a top channel 155 and a bottom channel 156. The top channel 155 can receive a bottom edge portion of a first pegboard section 152 and the bottom channel 156 can receive a top edge portion of a second pegboard section (not shown). Seam members 154 are sized to span the width of the corresponding pegboard sections 152.

Figure 9:
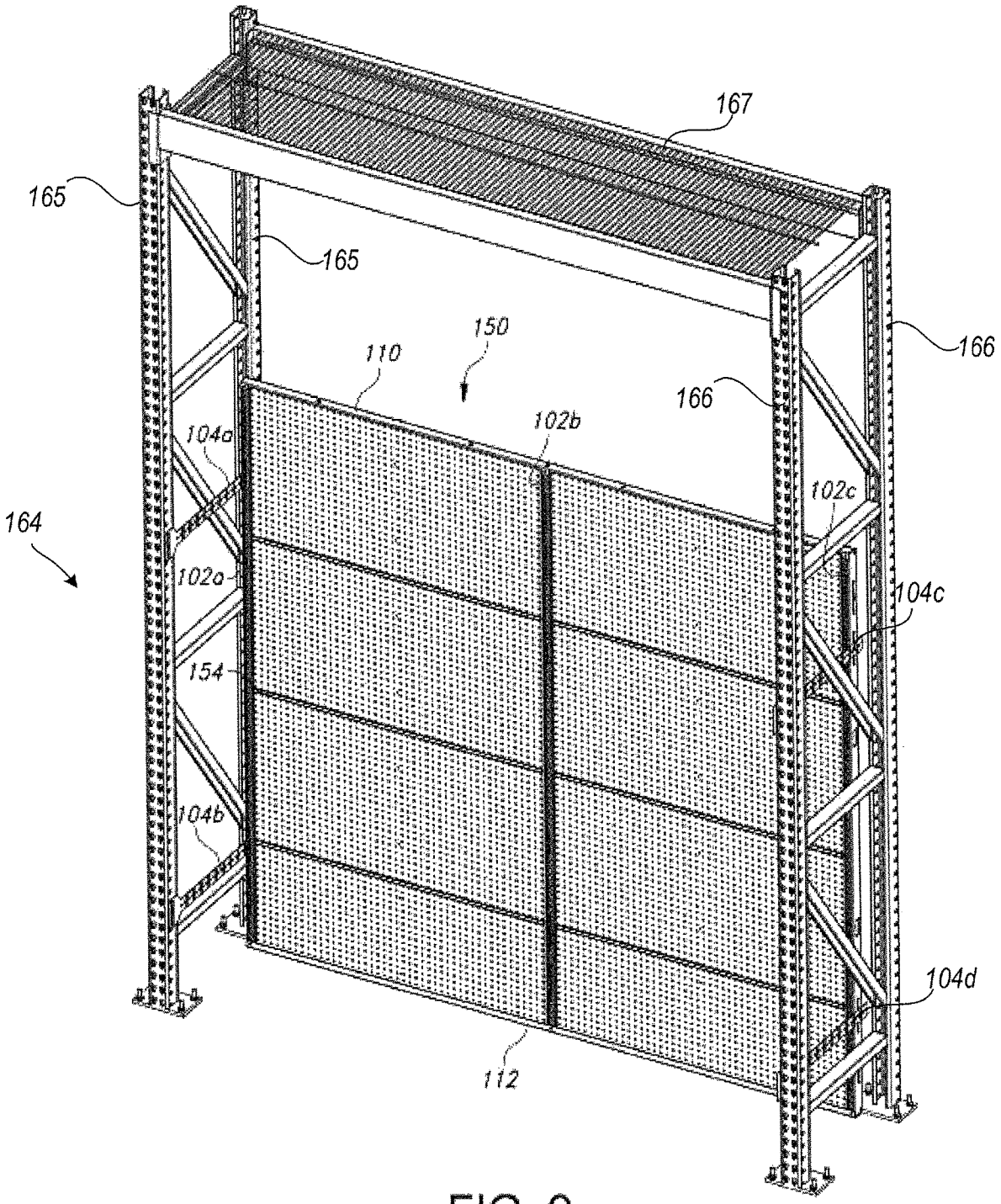
FIG. 9 illustrates a modular wall system integrated with a shelving unit, according to an example embodiment of the presently disclosed invention.
Figure 10:
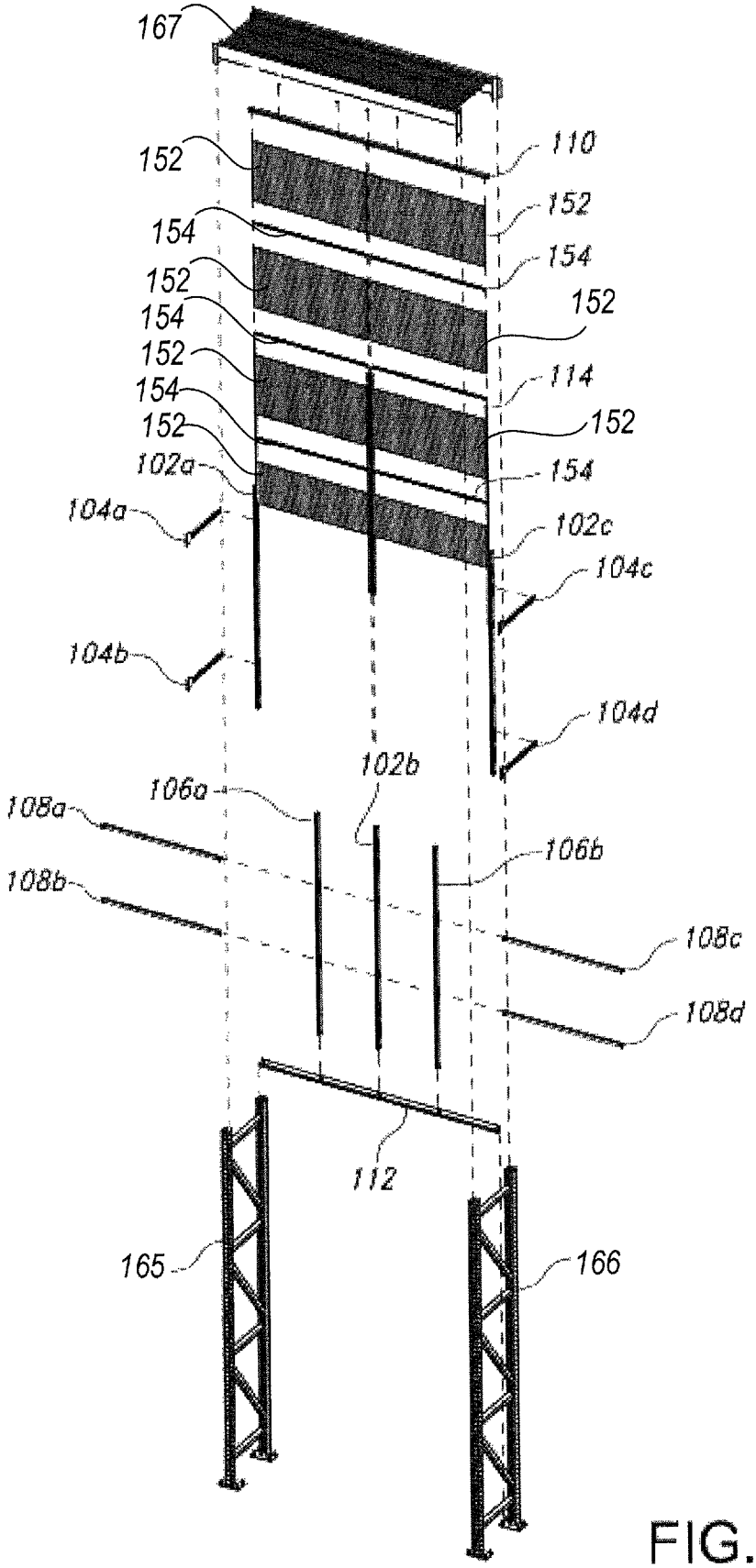
FIG. 10 is an exploded view illustrating a modular wall system integrated with a shelving unit, according to an example embodiment of the presently disclosed invention.

In some embodiments, the modular wall system 100 can be incorporated within an existing shelving unit, as illustrated in FIGS. 9 and 10. As illustrated in FIG. 9, the modular wall system 100 can connect to opposing vertical uprights 165, 166 of the shelving unit 164. The braces 104 of the modular wall system may be releasably affixed to a pair of side vertical uprights 165 or 166 and the vertical uprights 102*a*, 102*c* positioned and attached along the length of each brace 104*a*, 104*b*, 104*c*, 104*d* to achieve a desired depth of the system 100 relative to the front and rear vertical uprights 165, 166 of the shelving unit 164. In the example shown, shelving unit 164 further comprises an upper shelf 167 connected between the opposing pairs of vertical uprights 165, 166.

FIG. 10 is an exploded view of the modular wall system 100 and existing shelving unit 164 of FIG. 9. FIG. 9 exemplifies how the various components can be connected together and then incorporated within an existing shelving unit 164.

Figure 11A:
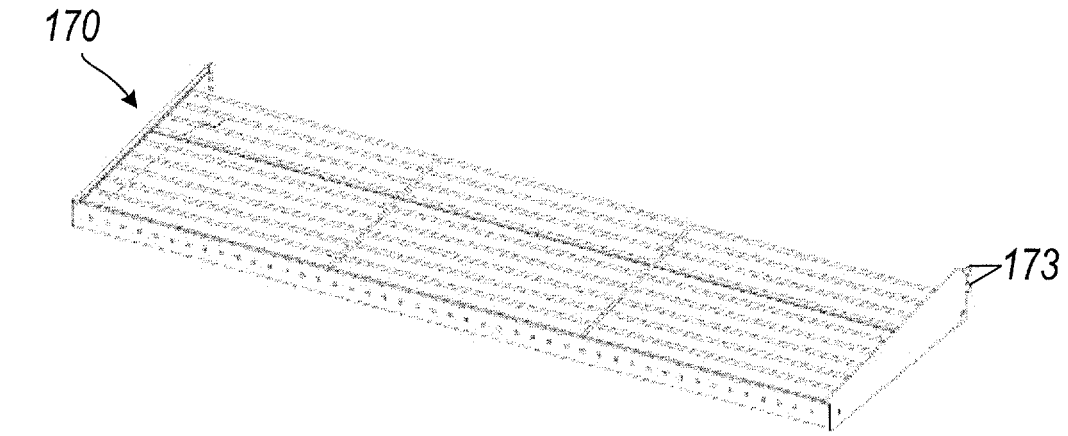
FIGS. 11A-11C illustrate various different types of shelves that can be incorporated with the modular wall system, according to an example embodiment of the presently disclosed invention.
Figure 11B:
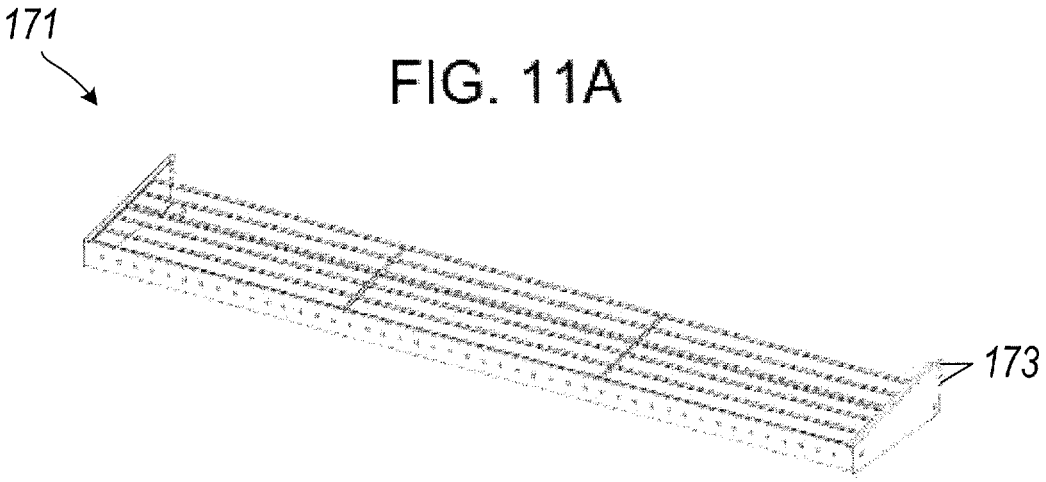
Figure 11C:
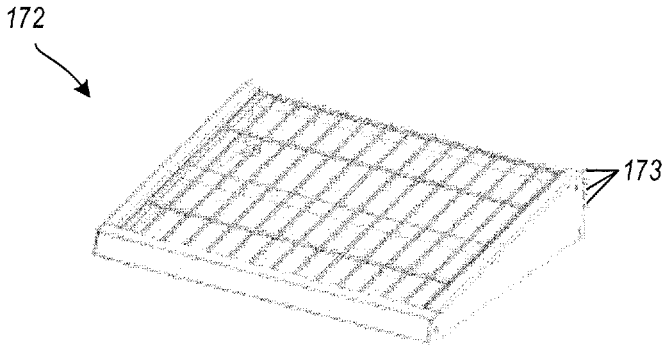
Figure 12:
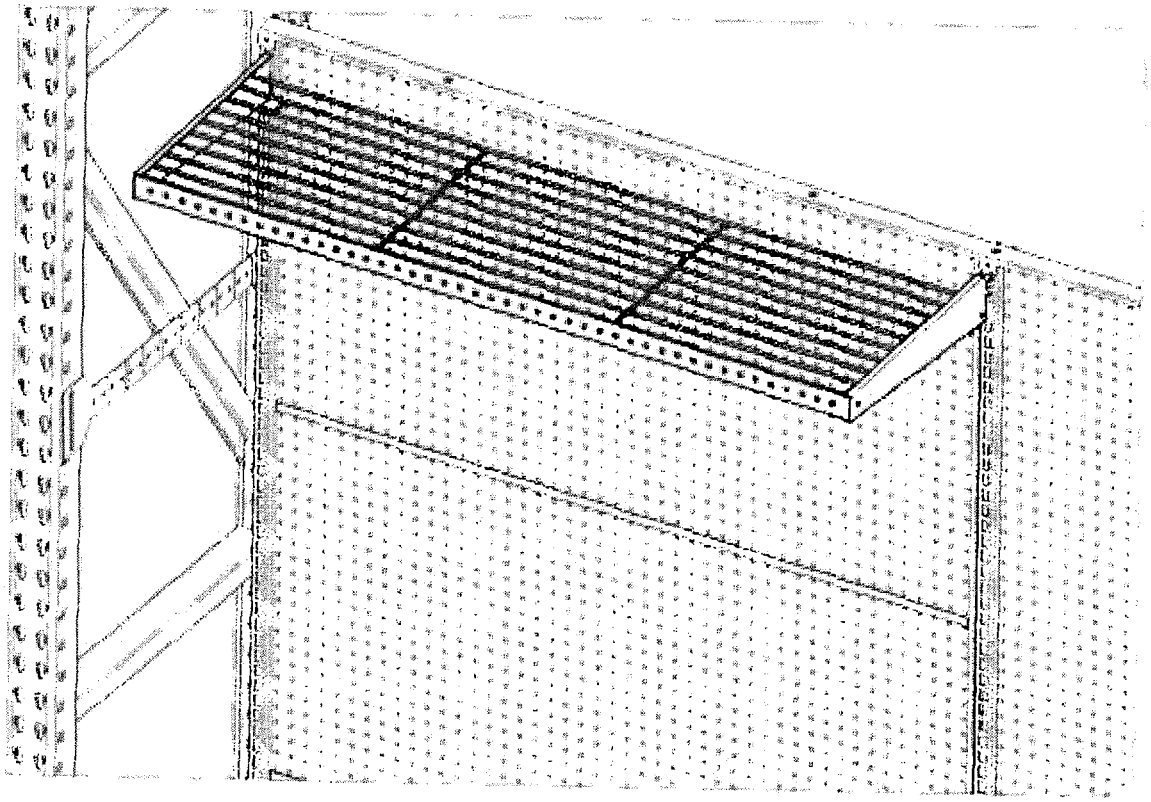
FIG. 12 illustrates a shelf attached to a modular wall system, according to an example embodiment of the presently disclosed invention.

In some embodiments, the modular wall system 100 can be configured to support a variety of accessories. FIGS. 11A-27 illustrate various accessories and how they can be incorporated with a modular wall system. FIGS. 11A-11C illustrate various sizes of shelves 170, 171, 172, respectively, that can be configured to connect with the vertical uprights (e.g., 102*a*, 102*b*, 102*c*) of the modular wall system 100. As illustrated in FIG. 12, one or more hooks 173 are adapted to engage with the vertical uprights 102*a*, 102*b*, 102*c*, such as engaging with one or more apertures 113. Note how the apertures 113 of the central vertical upright 102*b* may have a width that is wide enough to receive hooks 113 from two adjacent shelf units 170, 171, 172.

Figure 13:
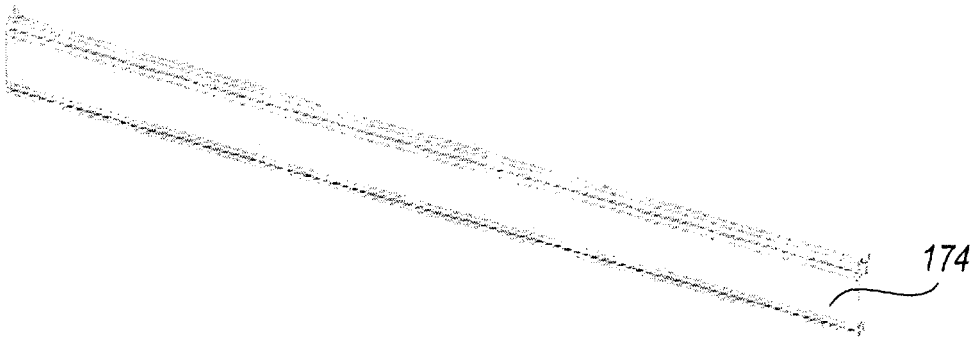
FIG. 13 illustrates a graphic display frame that can be incorporated with a modular wall system, according to an example embodiment of the presently disclosed invention.
Figure 14:
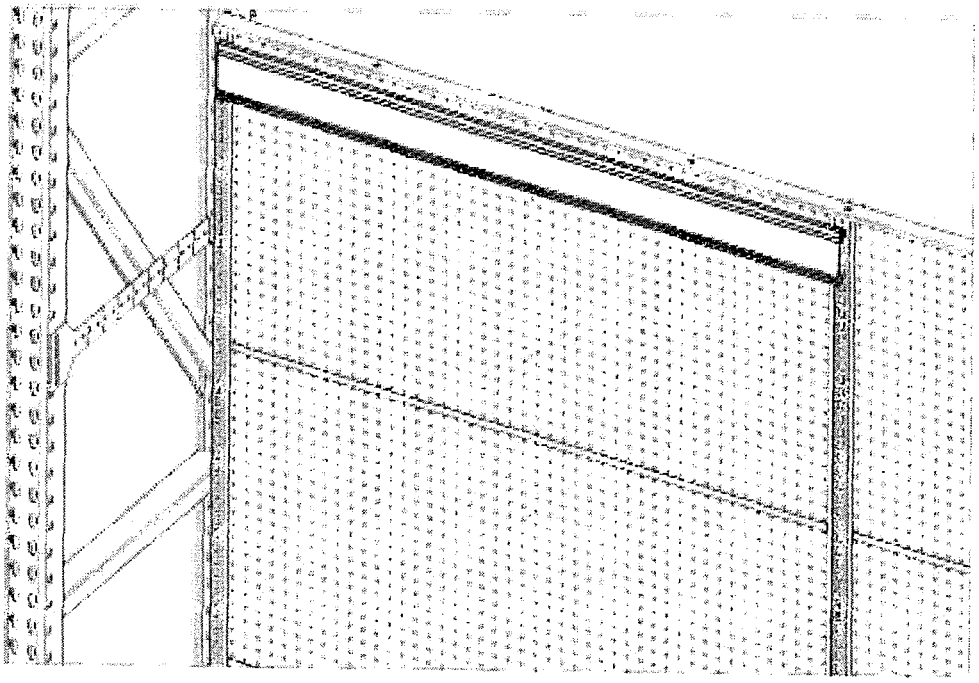
FIG. 14 illustrates a graphic display frame attached to a modular wall system, according to an example embodiment of the presently disclosed invention.
Figure 15:
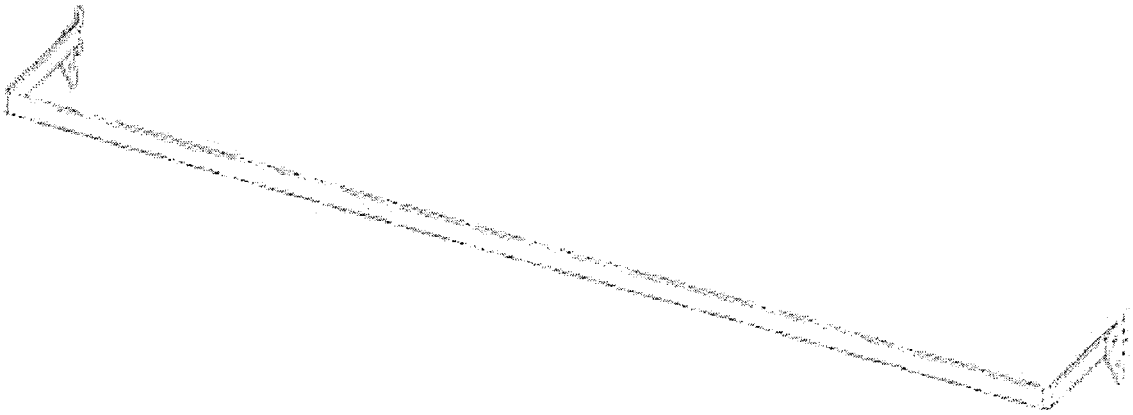
FIG. 15 illustrates a hang bar attached to a modular wall system, according to an example embodiment of the presently disclosed invention.
Figure 16:
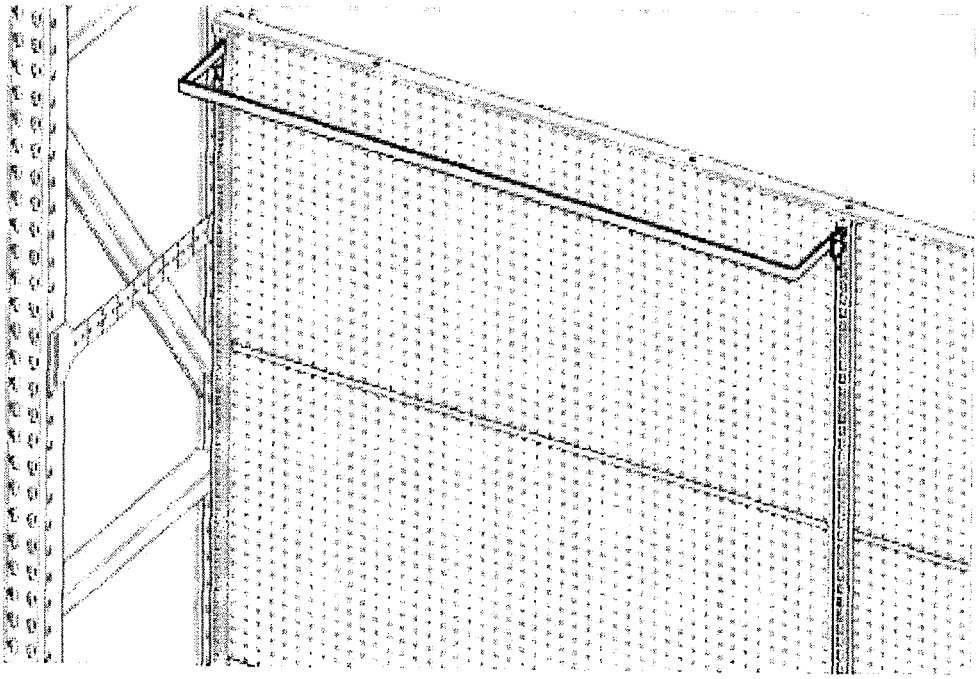
FIG. 16 illustrates a hang bar attached to a modular wall system, according to an example embodiment of the presently disclosed invention.
Figure 17:
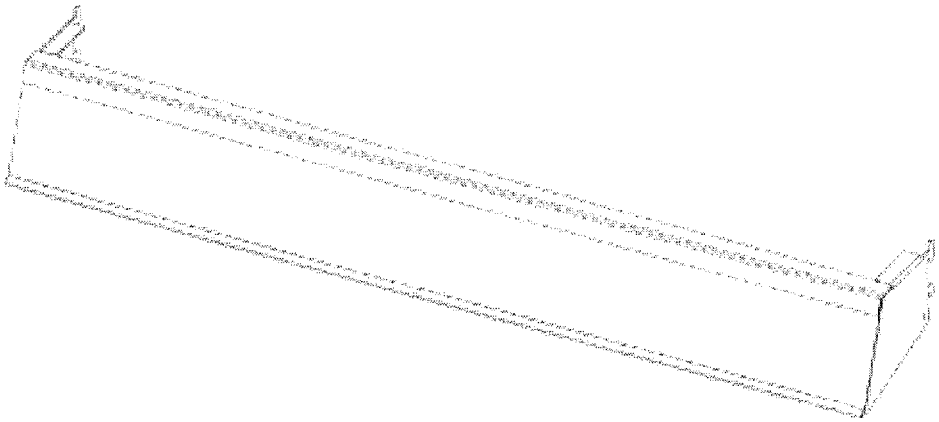
FIG. 17 illustrates another type of hang bar for holding pod units, according to an example embodiment of the presently disclosed invention.
Figure 19:
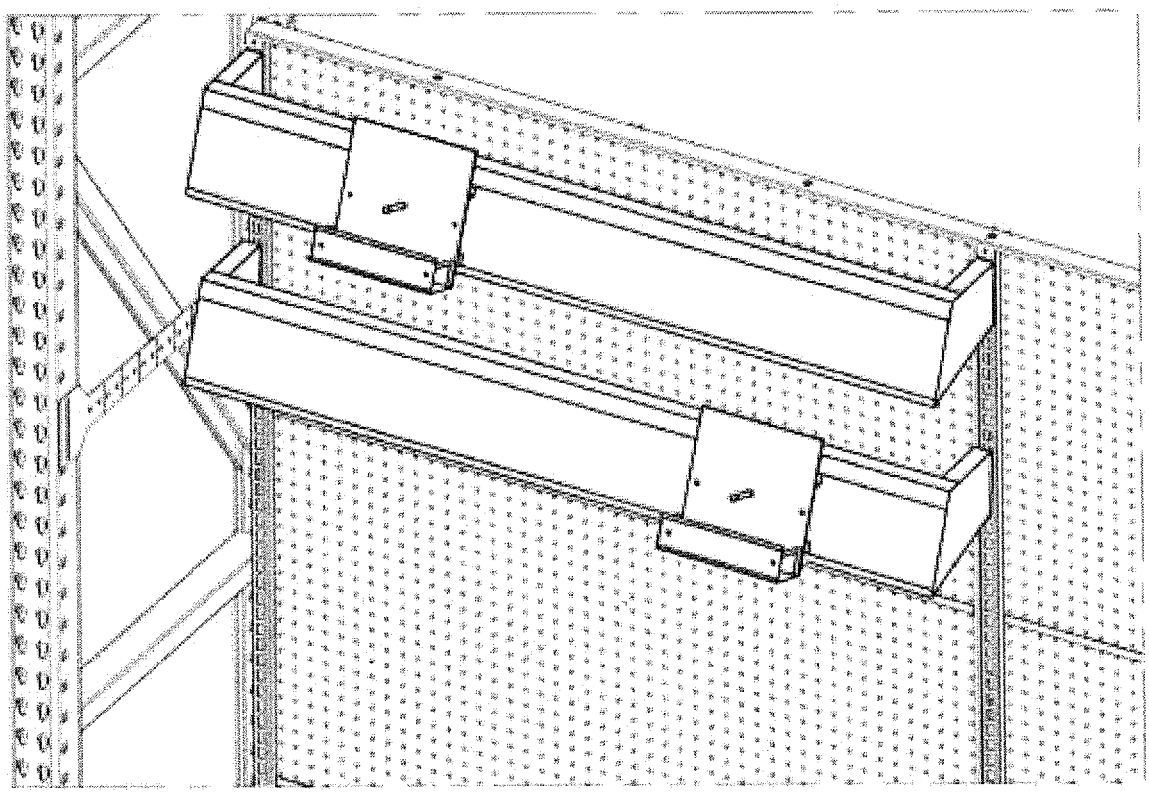
FIG. 19 illustrates a hang bar and pod unit attached to a modular wall system, according to an example embodiment of the presently disclosed invention.
Figure 20:
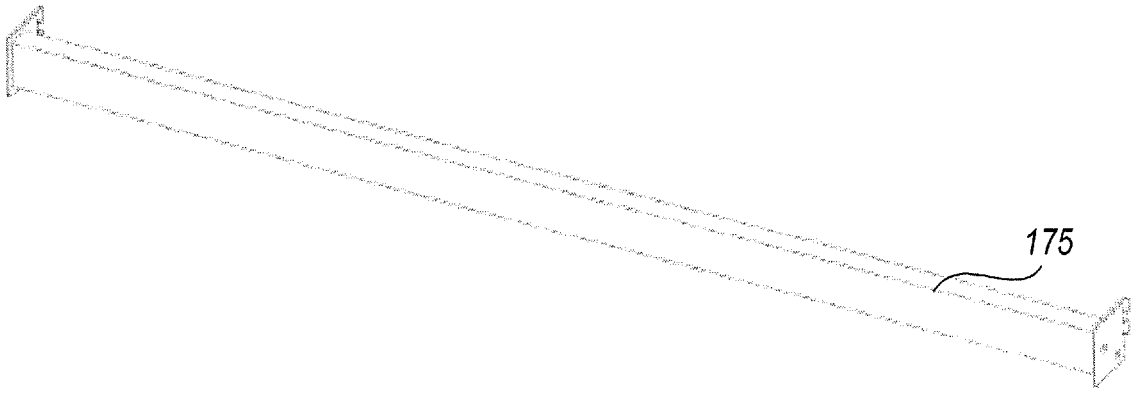
FIG. 20 illustrates another hang bar, according to an example embodiment of the presently disclosed invention.
Figure 21:
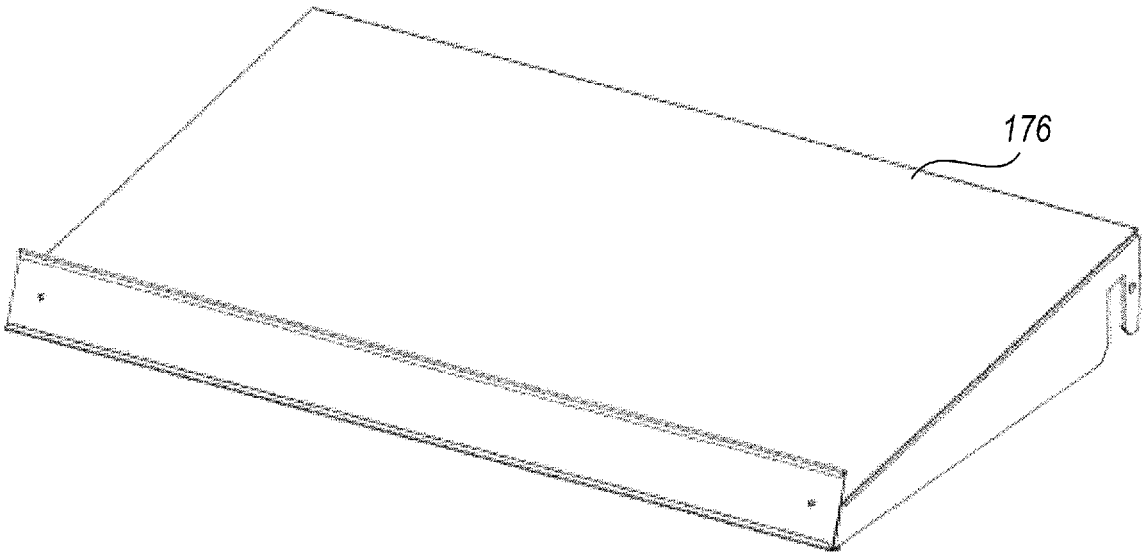
FIG. 21 illustrates a shelf that can attach to the hang bar in FIG. 20, according to an example embodiment of the presently disclosed invention.
Figure 22:
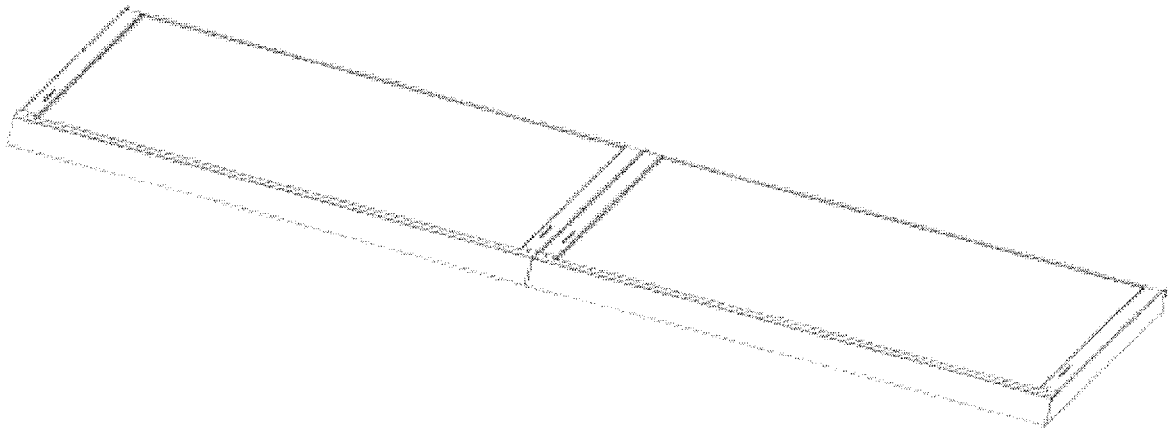
FIG. 22 illustrates a base, according to an example embodiment of the presently disclosed invention.
Figure 23:
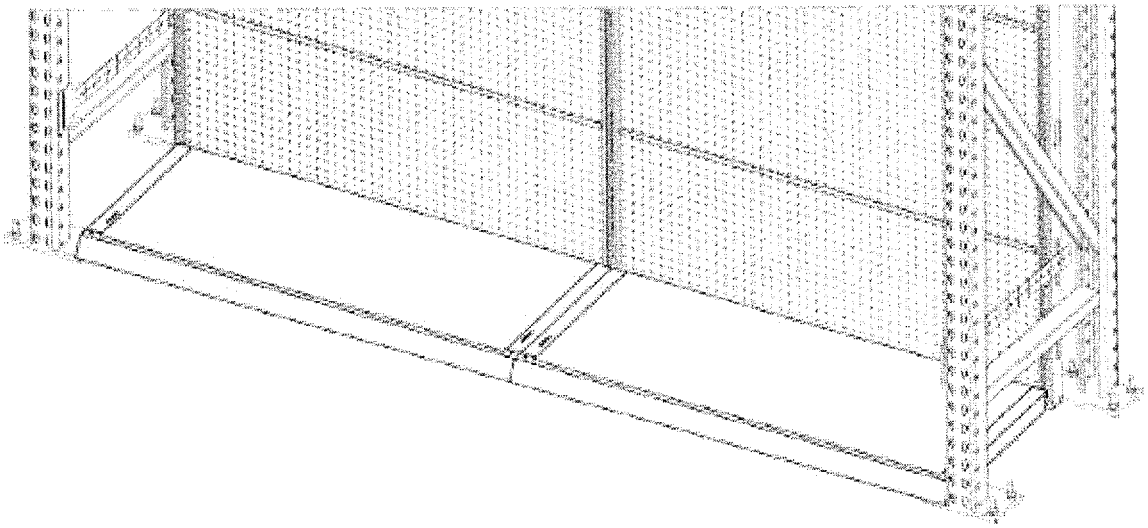
FIG. 23 illustrates a base connected to a modular wall system, according to an example embodiment of the presently disclosed invention.
Figure 24:
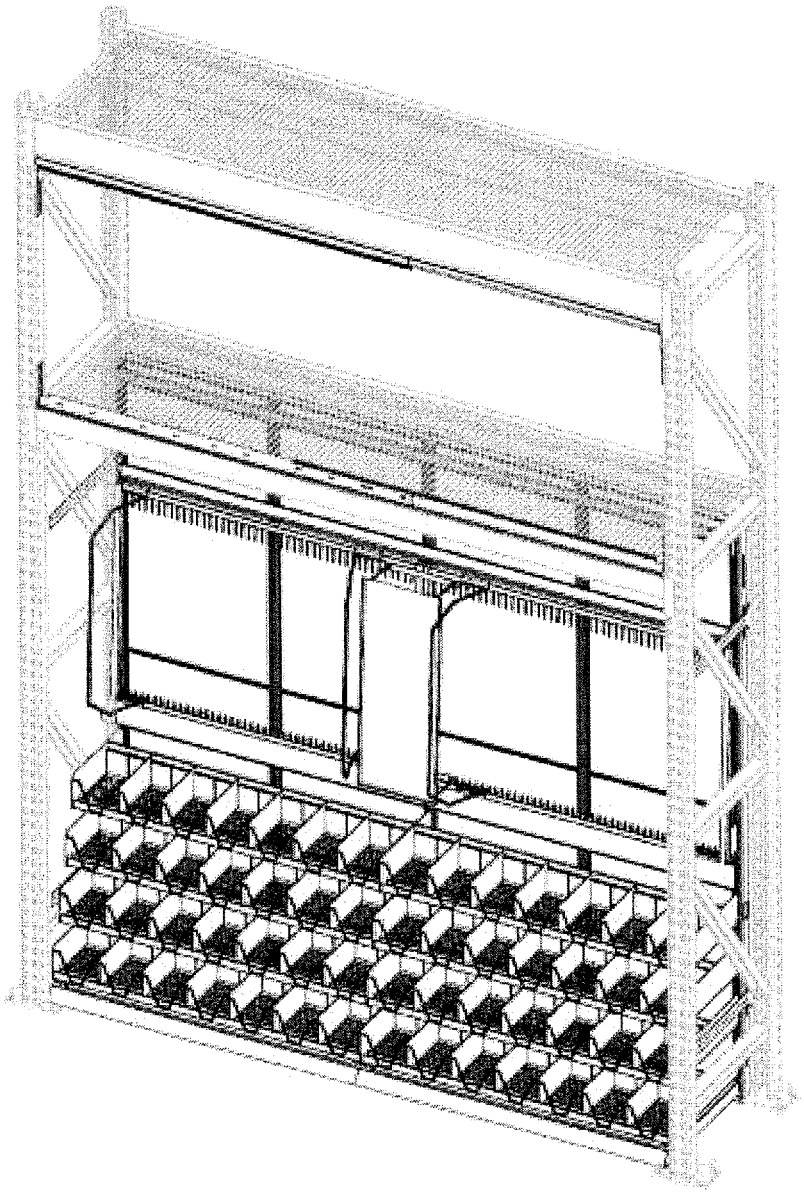
FIG. 24 illustrates a modular wall system including various different accessories, according to an example embodiment of the presently disclosed invention.
Figure 25:
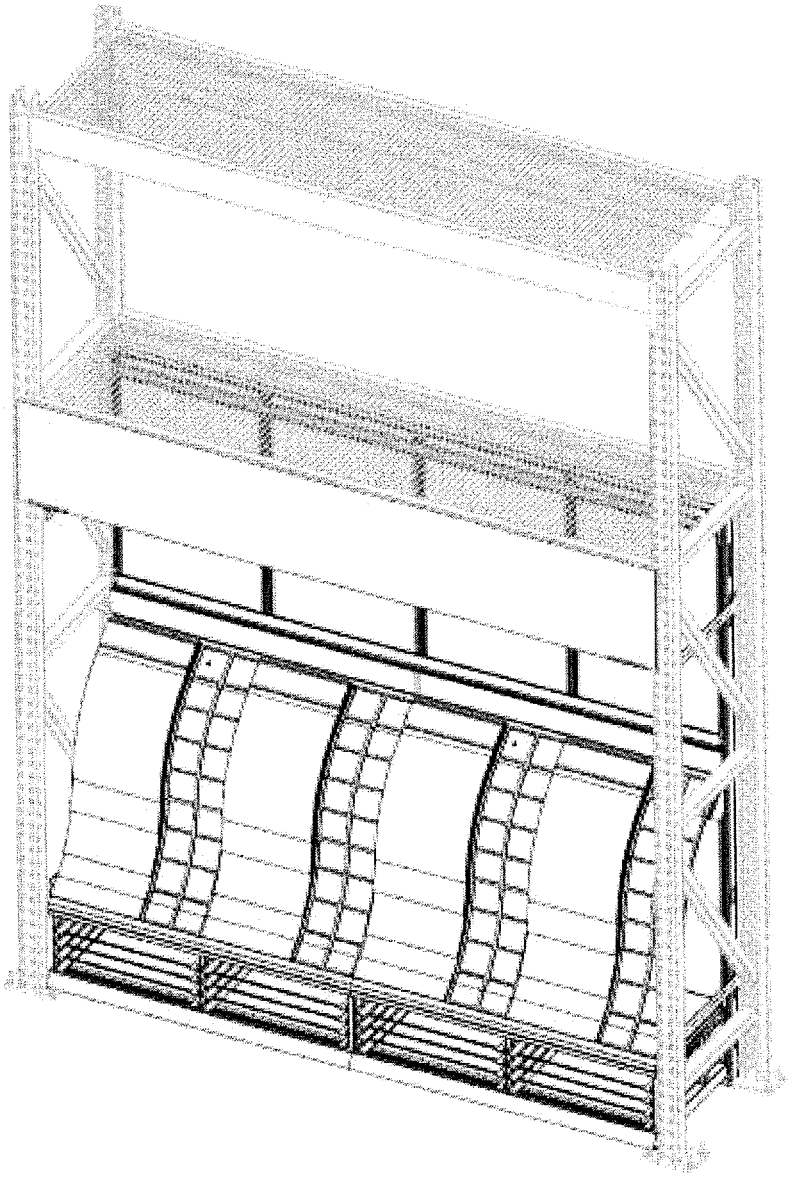
FIG. 25 illustrates a modular wall system including various different accessories, according to an example embodiment of the presently disclosed invention.
Figure 26:
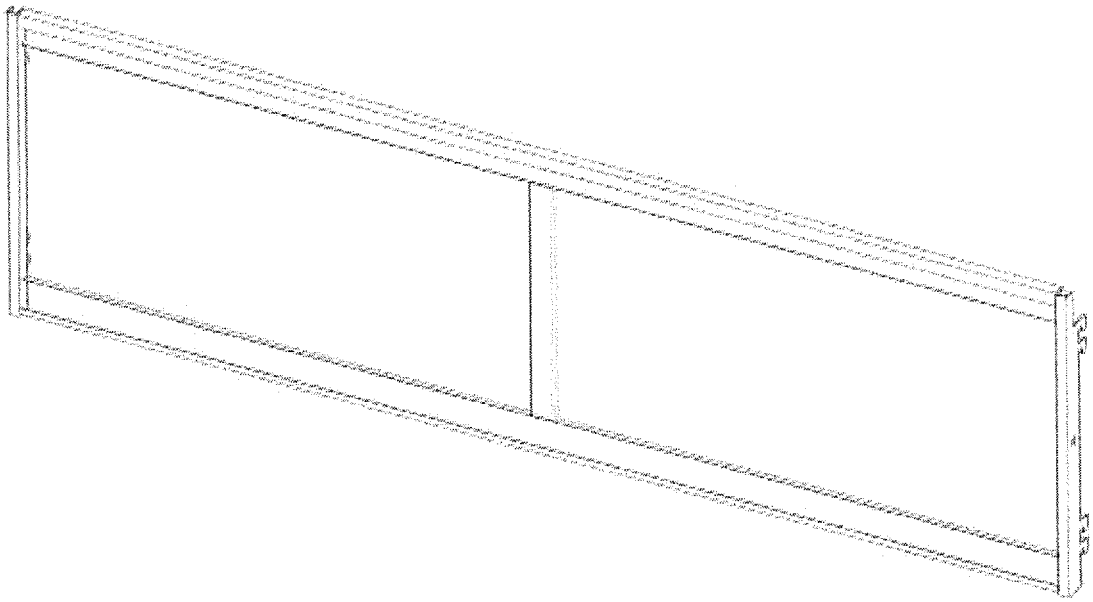
FIG. 26 illustrates a graphic display frame for incorporating with a modular wall system, according to an example embodiment of the presently disclosed invention.
Figure 27:
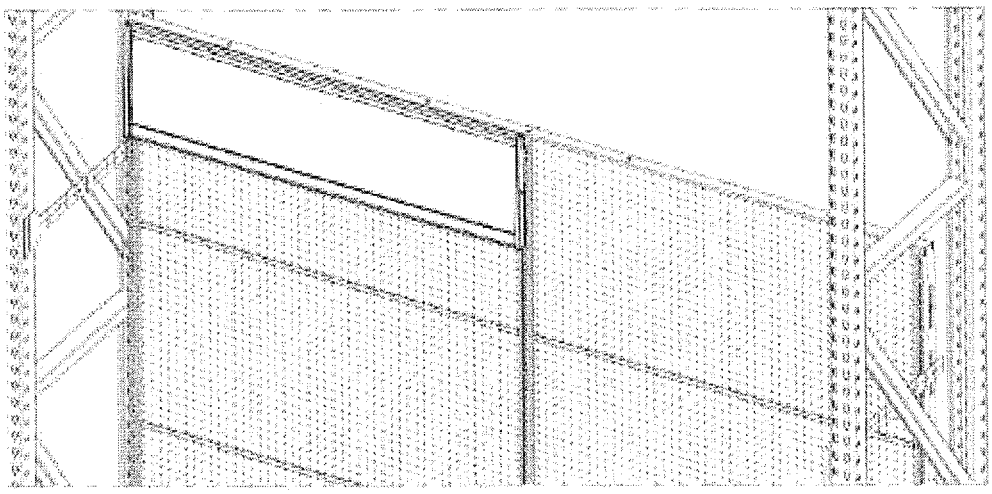
FIG. 27 illustrates a graphic display frame attached to a modular wall system, according to an example embodiment of the presently disclosed invention.

FIG. 13 illustrates a graphic display board 174 that can be configured to connect with the vertical uprights (e.g., 102*a*, 102*b*, 102*c*) of the modular wall system, as illustrated in FIG. 14. FIG. 15 illustrates a hang bar that can be configured to connect with the vertical uprights (e.g., 102*a*, 102*b*, 102*c*) of the modular wall system, as illustrated in FIG. 16. FIG. 17 illustrates a hang bar and FIG. 18 illustrates a pod unit. FIG. 19 illustrates that the hang bar can be connected with the vertical uprights (e.g., 102*a*, 102*b*, 102*c*) of the modular wall system and the pod unit can be hung on the hang bar. FIG. 20 illustrates another type of hang bar 175 that can be connected with the vertical uprights (e.g., 102*a*, 102*b*, 102*c*) of the modular wall system and be used to hang a shelf 176, such as that illustrated in FIG. 21. FIG. 22 illustrates a base that can be connected with the vertical uprights (e.g., 102*a*, 102*b*, 102*c*) of the modular wall system as illustrated in FIG. 23. FIGS. 24 and 25 illustrate a modular wall system comprising various types of accessories that can be attached to the modular wall system. FIG. 26 illustrates a graphic display board that can be connected with the vertical uprights (e.g., 102*a*, 102*b*, 102*c*) of the modular wall system as illustrated in FIG. 27. For instance, the modular wall system may be configured to include graphics that can highlight the product being merchandised.

Embodiments of the presently disclosed invention can comprise a kit for a modular wall system. The kit can comprise a variety of components that when assembled can form the modular wall system. In some embodiments, the kit can comprise a plurality of vertical uprights having a predetermined length, a top cap, a bottom cap, a plurality of vertical support members, a plurality of horizontal support members, a plurality of pegboard sections chosen from the group consisting of metal pegboard and wood pegboard, a plurality of seam members, and a plurality of brackets.

In some embodiments, the kit can comprise three vertical uprights, two vertical support members, eight pegboard sections, four brackets, six seams, one top cap, and one bottom cap.

In some embodiments, the kit can comprise two containers, one comprising the larger components (e.g., the vertical uprights, the top cap, the bottom cap, and the vertical support members) and the other comprising smaller components (e.g., the pegboard sections, brackets, vertical support members, and seams). This can facilitate easy shipping and movability of the kit.

In an example embodiment, and without regard to height or configuration of modular wall system, an 8' wide section (most common size) of the modular wall system can be shipped via package delivery in two cartons. The first carton can have dimensions of about 97"×6"×3" and weigh approximately 75 pounds. This carton contains only metal components. The second carton can have dimensions of about 24"×48"×3" and weigh between 20 and 75 pounds depending on material type and configuration. The carton contains assembly hardware, small metal components, all panels (e.g., wood peg panels, metal peg panels, blank wood panels or plastic panels as required per configuration). Both cartons can be shipped via traditional package shipping companies.

The various components of the kit can be composed of plastic, wood, and/or metal. For instance, the seams can be composed of plastic, the pegboard sections can be composed of wood or metal, and the remaining components may be composed of metal.

In some embodiments, the kit can comprise various fasteners for coupling various components together such as split end lock washers, threaded rack anchors, Philips head screws and half hex rivet nuts.

While the above-described embodiments are discussed in the context of retailing or merchandising, it is understood that the presently disclosed modular wall systems and kits can be configured for other uses such as for individual use, such as for home storage or display.

Numerous alterations of the structure herein disclosed will suggest themselves to those skilled in the art. However, it is to be understood that the present disclosure relates to example embodiments, which are for purposes of illustration only and not to be construed as a limitation of the invention. All such modifications which do not depart from the spirit of the invention are intended to be included within the scope of the appended claims.

I claim:

1. A modular wall system for use in accordance with a shelving unit comprising:

a frame composed of:

a plurality of vertical uprights;

a top cap; and a bottom cap;

a plurality of vertical support members removably coupled to the frame;

a plurality of pegboard sections removably disposed within the frame, the plurality of pegboard sections interconnected via at least one seam member; and a plurality of brackets removably coupled to the frame and configured to couple to any of a plurality of different vertical positions along the vertical uprights, the plurality of brackets comprising:

a brace member comprising a plurality of holes disposed lengthwise across the brace member and configured to removably couple with any of the plurality of different vertical positions along the vertical uprights; and a flange comprising one or more slots configured to removably couple with the shelving unit.

2. The modular wall system of claim 1, further comprising a plurality of horizontal support members coupled to the frame.

3. The modular wall system of claim 1, wherein the plurality of vertical uprights comprises a first outer vertical upright, a central vertical upright, and a second outer vertical upright.

4. The modular wall system of claim 3, wherein the first and second outer vertical uprights each comprise a channel configured to couple to at least one of the plurality of pegboard sections.

5. The modular wall system of claim 3, wherein the central vertical upright comprise two channels, each channel disposed on a corresponding vertical edge of the central vertical upright and configured to couple to at least one of the plurality of pegboard sections.

6. The modular wall system of claim 1, wherein each of the plurality of vertical uprights comprise a top connector configured to removably couple to the top cap and a bottom connector configured to removably couple to the bottom cap.

7. The modular wall system of claim 1, further comprising a plurality of accessories including one or more of a shelf, a graphic display board, a hang bar, a base, or a pod unit.

8. The modular wall system of claim 1, wherein the plurality of pegboard sections are composed of a metal.

9. The modular wall system of claim 1, wherein the at least one seam member comprises a top channel for receiving a bottom edge of a first pegboard section and a bottom channel for receiving a top edge of a second pegboard section.

10. A kit comprising components for constructing a modular wall system, the components comprising:

a plurality of vertical uprights;

a top cap;

a bottom cap;

a plurality of vertical support members;

a plurality of pegboard sections chosen from the group consisting of metal pegboard and wood pegboard;

a plurality of seam members; and a plurality of brackets configured to couple to any of a plurality of different vertical positions along the plurality of vertical uprights, the plurality of brackets comprising:

a brace member comprising a plurality of holes disposed lengthwise across the brace member and configured to removably couple with any of the plurality of different vertical positions along the vertical uprights.

11. The kit of claim 10, wherein the components further comprise a plurality of fasteners chosen from the group consisting of split end lock washers, threaded rack anchors, Philips head screws, half hex rivet nuts, and sem screws.

12. The kit of claim 10, wherein the components comprise:

three of said vertical uprights;

two of said vertical support members;

eight of said pegboard sections;

four of said brackets; and six of said seam members.

13. The kit of claim 12, wherein the components further comprise a plurality of horizontal support members.

14. The kit of claim 13, wherein the components comprise four horizontal support members.

15. The kit of claim 10, wherein the brackets comprise:

a flange comprising one or more slots for coupling to a shelving unit.

16. The kit of claim 10, wherein the plurality of vertical uprights comprises a first outer vertical upright, a central vertical upright, and a second outer vertical upright.

17. The kit of claim 16, wherein the first and second outer vertical uprights each comprise a channel for coupling with at least one of the plurality of pegboard sections.

18. The kit of claim 16, wherein the central vertical upright comprise two channels, each channel disposed on a corresponding vertical edge of the central vertical upright and for coupling with at least one of the plurality of pegboard sections.

19. The kit of claim 16, wherein each of the plurality of vertical uprights comprise a top connector and a bottom connector.

20. The kit of claim 16, further comprising a plurality of accessories including one or more of a shelf, a graphic display board, a hang bar, a base, or a pod unit.

* * * * *